US009581174B2

(12) United States Patent
Koike et al.

(10) Patent No.: US 9,581,174 B2
(45) Date of Patent: Feb. 28, 2017

(54) FAN FRAME

(71) Applicant: SANYO DENKI CO., LTD., Tokyo (JP)

(72) Inventors: Masahiro Koike, Tokyo (JP); Souma Araki, Tokyo (JP); Toshiki Ogawara, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 643 days.

(21) Appl. No.: 13/874,846

(22) Filed: May 1, 2013

(65) Prior Publication Data

US 2013/0302190 A1 Nov. 14, 2013

(30) Foreign Application Priority Data

May 11, 2012 (JP) ..... 2012-110055

(51) Int. Cl.
*F04D 29/52* (2006.01)
*F04D 25/06* (2006.01)
*F04D 29/60* (2006.01)

(52) U.S. Cl.
CPC ..... *F04D 29/522* (2013.01); *F04D 25/0613* (2013.01); *F04D 29/601* (2013.01)

(58) Field of Classification Search
CPC .. F16B 35/065; F04D 29/522; F04D 25/0613; F04D 29/601
USPC ..... 411/303, 399; 470/199; 409/69
See application file for complete search history.

(56) References Cited

U.S. PATENT DOCUMENTS 350,231 A * 10/1886 Brown ..... F16B 35/06 411/399
3,255,797 A * 6/1966 Attwood ..... F16B 35/065 411/188
5,678,962 A * 10/1997 Hyatt ..... B23G 5/188 408/222
5,890,860 A * 4/1999 Dorris ..... F16B 35/048 411/399
6,494,655 B1 * 12/2002 Pritchard ..... F16B 25/00 411/399
7,118,317 B2 * 10/2006 Hofschneider ..... F16B 35/06 411/380
7,344,358 B2 3/2008 Lu et al.
(Continued)

FOREIGN PATENT DOCUMENTS

EP 2381111 A2 10/2011
GB 1406846 A 10/1975
(Continued)

OTHER PUBLICATIONS

Extended European Search Report of foreign counterpart application EP13164609.3 dated Feb. 25, 2016.

*Primary Examiner* — Ninh H Nguyen
*Assistant Examiner* — Aaron R Eastman
(74) *Attorney, Agent, or Firm* — Polsinelli PC

(57) ABSTRACT

A fan frame accommodates a fan for blowing air or cooling and has a hole into which a tapping screw is fixed. The hole has a first hole portion opened in an attachment surface onto which a supporting member fixed by the tapping screw is attached and a second hole portion extending from the first hole portion and having a predetermined inner diameter. The first hole portion of the hole is formed to have a diameter larger than that of the second hole portion.

14 Claims, 19 Drawing Sheets

(56) References Cited

U.S. PATENT DOCUMENTS

| | | | | |
|---|---|---|---|---|
| 7,589,967 | B2 * | 9/2009 | Zhou | H01L 23/4006 165/185 |
| 2002/0106260 | A1 * | 8/2002 | Schenk | F16B 35/06 411/399 |
| 2002/0131842 | A1 * | 9/2002 | Eriksson | F16B 4/004 411/399 |
| 2007/0274821 | A1 * | 11/2007 | Yoshida | F04D 19/007 415/68 |
| 2008/0008576 | A1 * | 1/2008 | Hong | F04D 19/007 415/68 |
| 2011/0255957 | A1 | 10/2011 | Inada et al. | |

FOREIGN PATENT DOCUMENTS

| | | | |
|---|---|---|---|
| JP | H07151099 | A | 6/1995 |
| JP | H09291913 | A | 11/1997 |
| JP | H10-196625 | A | 7/1998 |
| JP | 2006017117 | A | 1/2006 |
| JP | 2007-120348 | A | 5/2007 |
| JP | 2011-117472 | A | 6/2011 |

* cited by examiner

FAN FRAME

CROSS-REFERENCE TO RELATED APPLICATION

This application claims priority to Japanese Application No. 2012-110055, filed May 11, 2012, the entirety of which is incorporated herein by reference.

BACKGROUND

1. Technical Field

The invention relates to a fan frame in which a fan for blowing air or cooling is accommodated.

2. Description of Related Arts

In the prior art, there has been widely adopted a configuration in which a fan frame in which a fan with a plurality of blades is accommodated is attached to a supporting member provided in a personal computer, and the fan is rotated to dissipate heat generated from a heat generator like CPU (Central Processing Unit). The fan frame includes, for example, a housing having an opening, a motor base located in the housing, and a plurality of ribs supporting the motor base between a peripheral edge of the opening and the motor base (see, Japanese Patent Application Laid-Open Publication No. 2006-017117).

A fan frame is attached to a supporting member on the personal computer side with a tapping screw. At this time, if a hole of the fan frame is damaged when the tapping screw is inserted through the hole, the fan frame is not satisfactorily fixed to the supporting member, and this causes vibration and noise. If the hole of the fan frame is deteriorated over the ages while being partially damaged in the attachment of the tapping screw and the hole is fractured, this causes dropping-out of the fan frame from the supporting member. However, in a conventional fan frame, there has been no configuration in which the hole into which the tapping screw is fixed is prevented from being damaged by the tapping screw.

That is, in the conventional fan frame, when the tapping screw is fixed into the hole of the fan frame, cracking may occur around the hole. The tapping screw is a screw to be fixed into the hole of the fan frame molded with, for example, a resin while forming a screw groove in an inner circumferential surface of the hole. In the conventional fan frame, the hole has a straight shape, and an entrance portion of the hole through which the tapping screw is inserted is formed into a right angle, and thus a very large load is applied to the entrance portion of the hole.

Especially, when the tapping screw inclining in the axial direction of the hole of the conventional fan frame is fixed into the hole, an excessive load is applied to the entrance portion of the hole, and cracking or the like is often formed around the hole. Manufacturing errors may occur in the diameter of the hole of the fan frame, and the tapping screw to be fixed into the hole has various specifications. Accordingly, even if the tapping screw is fixed into the hole of the conventional fan frame to be vertical in the axis direction of the hole, an excessive load is applied to the entrance portion of the hole, whereby cracking and so on may occur.

Thus, in the conventional fan frame, the insertion of the tapping screw into the hole of the fan frame is required to be visually confirmed at one place thereof to prevent the inclination of the tapping screw. Since the tapping screw is vertically inserted into the hole of the fan frame, a jig which corrects the inclination of the tapping screw is required to be used. Accordingly, there has been a problem that a process for assembling the fan frame becomes complex.

SUMMARY

This invention provides a fan frame in which a hole into which a tapping screw is fixed is not damaged by the tapping screw, and the assembly process can be simplified.

To achieve the above object, a fan frame accommodates a fan for blowing air or cooling and has a hole into which a fixing member is fixed. This hole has a first hole portion opened in an attachment surface onto which a supporting member fixed by a fixing member is attached and a second hole portion extending from the first hole portion and having a predetermined inner diameter. The first hole portion is formed to have a diameter larger than that of the second hole portion.

A fan frame according to this invention has a hole having a first hole portion and a second hole portion, and the first hole portion opened in an attachment surface onto which a supporting member is attached is formed to have a diameter larger than that of the second hole portion extending from the first hole portion, so that a hole into which a fixing member is fixed is not damaged by the fixing member, and the assembly process can be simplified.

BRIEF DESCRIPTION OF THE DRAWINGS

FIG. 7A is a perspective view illustrating a cross section of the shape of the hole, and FIG. 7B is a side view illustrating a cross section of the shape of the hole;

FIG. 8A is a perspective view illustrating a cross section of the shape of the hole, and FIG. 8B is a side view illustrating a cross section of the shape of the hole;

FIG. 10A is a perspective view illustrating a cross section of the shape of the hole, and FIG. 10B is a side view illustrating a cross section of the shape of the hole;

FIG. 11A is a perspective view illustrating a cross section of the shape of the hole, and FIG. 11B is a side view illustrating a cross section of the shape of the hole;

FIG. 12A is a perspective view illustrating a cross section of the shape of the hole, and FIG. 12B is a side view illustrating a cross section of the shape of the hole;

FIG. 13A is a perspective view illustrating a cross section of the shape of the hole, and FIG. 13B is a side view illustrating a cross section of the shape of the hole;

FIG. 14A is a perspective view illustrating a cross section of the shape of the hole, and FIG. 14B is a side view illustrating a cross section of the shape of the hole;

FIG. 15A is a perspective view illustrating a cross section of the shape of the hole, and FIG. 15B is a side view of a cross section of the shape of the hole;

FIG. 16A is a perspective view illustrating a cross section of the shape of the hole, and FIG. 16B is a side view illustrating a cross section of the shape of the hole;

FIG. 17A is a perspective view illustrating a cross section of the shape of the hole, and FIG. 17B is a side view illustrating a cross section of the shape of the hole;

FIG. 23 is a side view illustrating a cross section of a state in which the tapping screw constituted of the tapping screw is fixed into the hole of the fan frame according to the second embodiment through the supporting member.

DETAILED DESCRIPTION

Figure 1:
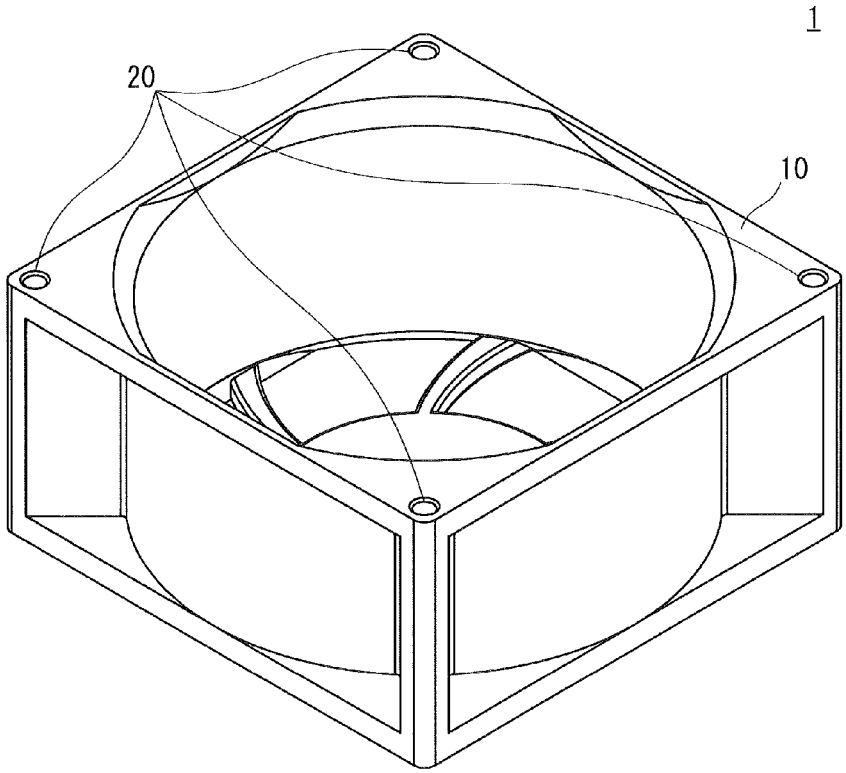
FIG. 1 is a perspective view illustrating a fan frame according to a first embodiment.

Hereinafter, embodiments of this invention will be described with reference to the accompanying drawings. In the description of the drawings, the same components are denoted by the same reference symbols, and redundant explanations thereof are omitted. Moreover, the size and ratio of each component in the drawings are exaggerated for convenience of description and not always equal to actual size and ratio.

First Embodiment

A fan frame 1 according to a first embodiment accommodates a fan 100 for blowing air or cooling and has a hole 20 into which a tapping screw 300 is fixed. The fan frame 1 of the first embodiment has a shape corresponding to a complete rib shape in which the hole 20 is inserted through the entire region ranging from an attachment surface 10 to a surface facing the attachment surface 10. The fan frame 1 according to the first embodiment will be specifically described with reference to FIGS. 1 to 17.

First, the shape and so on of the hole 20 of the basic fan frame 1 of the first embodiment will be sequentially described with reference to FIGS. 1 to 7.

Figure 2:
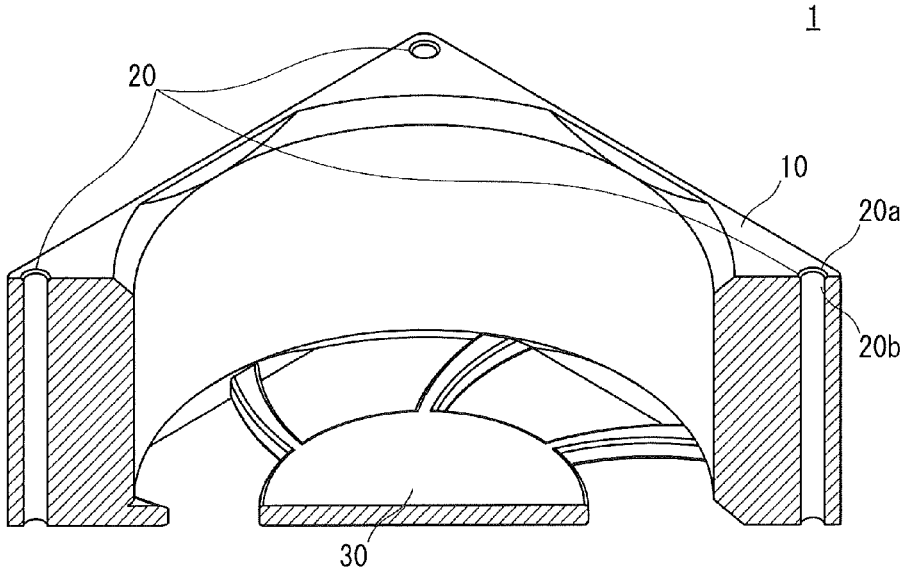
FIG. 2 is a perspective view illustrating a cross section of the fan frame according to the first embodiment.
Figure 3:
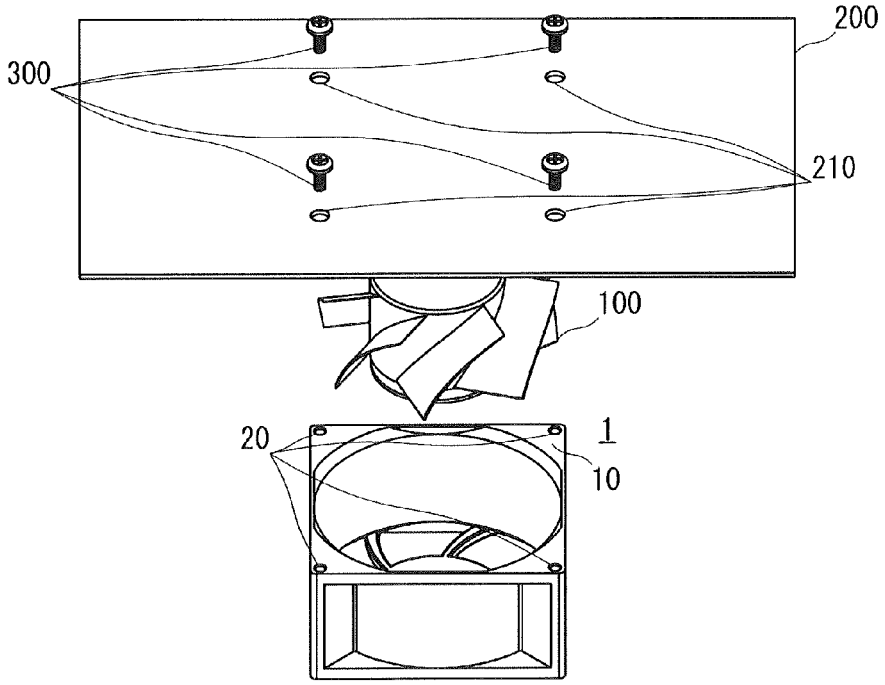
FIG. 3 is an exploded perspective view illustrating a state in which a fan is accommodated in the fan frame according to the first embodiment, a supporting member is attached onto an attachment surface of the fan frame, and tapping screws are fixed into holes of the fan frame through the supporting member.
Figure 4:
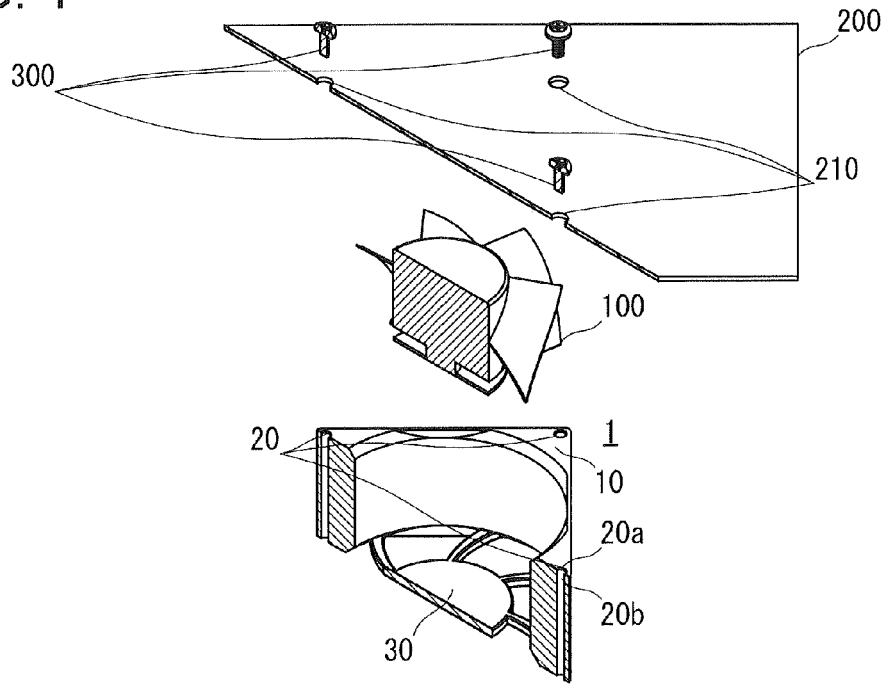
FIG. 4 is an exploded perspective view illustrating a cross section of the state in which the fan is accommodated in the fan frame according to the first embodiment, the supporting member is attached onto the attachment surface of the fan frame, and the tapping screws are fixed into the holes of the fan frame through the supporting member.
Figure 5:
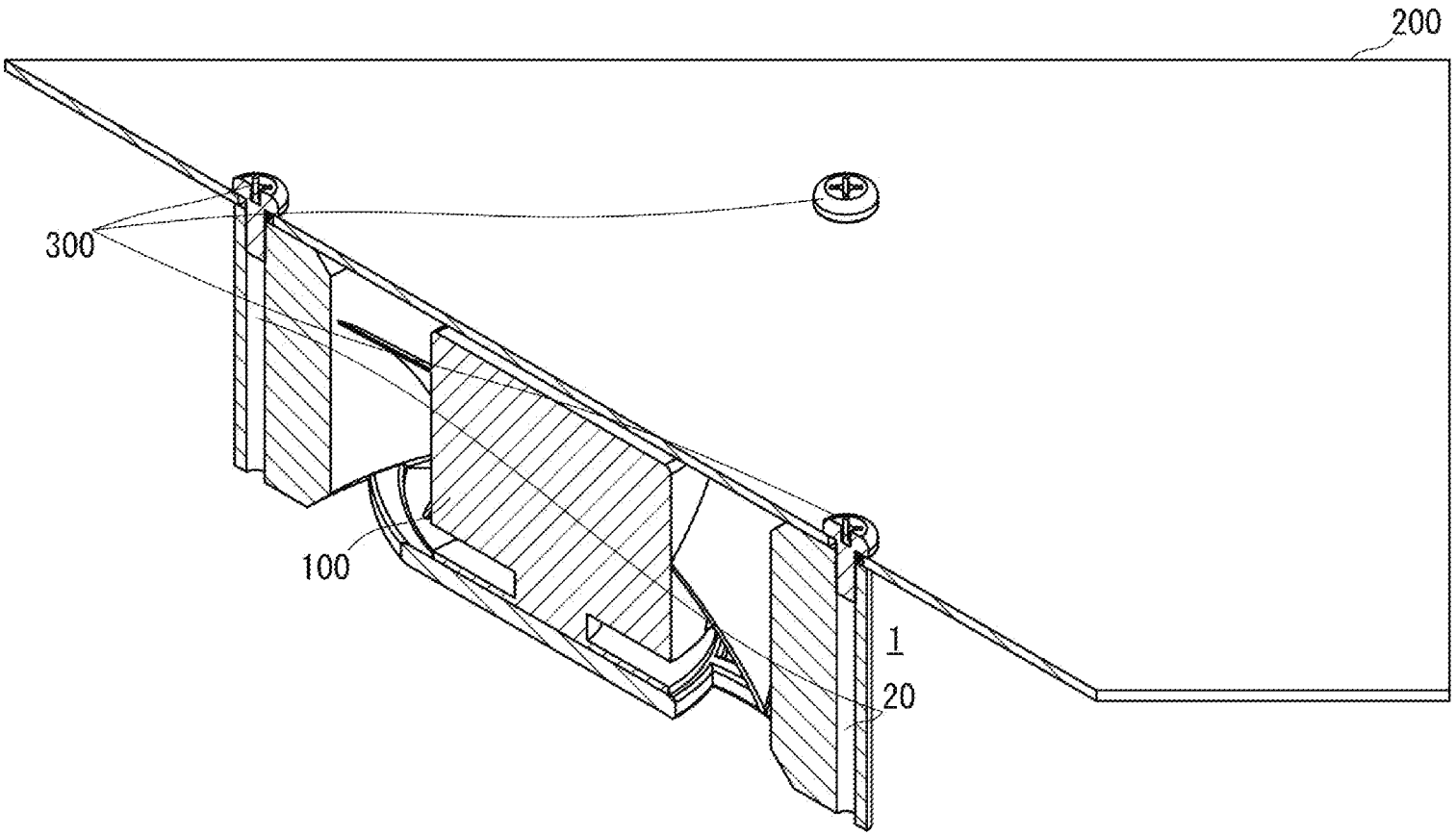
FIG. 5 is a perspective view illustrating a cross section of the state in which the fan is accommodated in the fan frame according to the first embodiment, the supporting member is attached onto the attachment surface of the fan frame, and the tapping screws are fixed into the holes of the fan frame through the supporting member.
Figure 6:
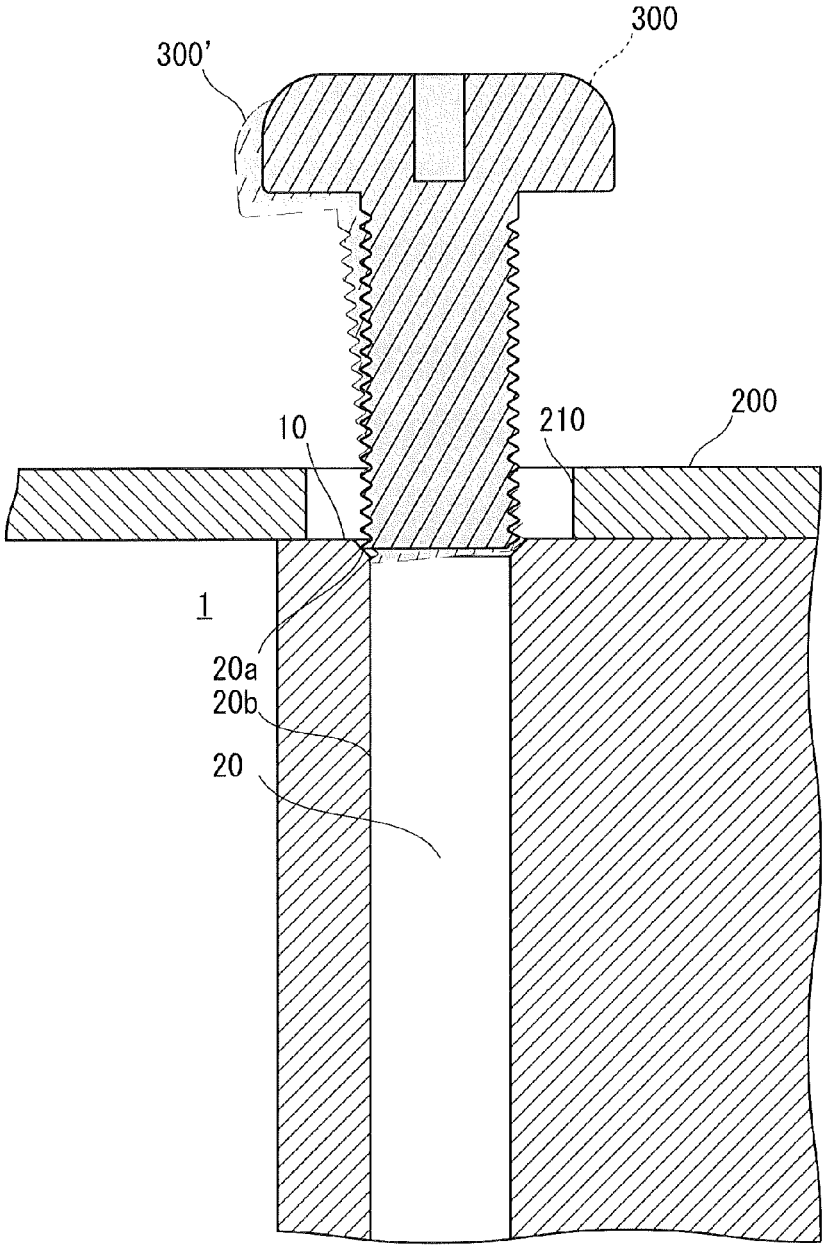
FIG. 6 is a side view illustrating a cross section of a state in which the tapping screw constituted of a tapping screw is fixed into the hole of the fan frame according to the first embodiment through the supporting member.
Figure 7A:
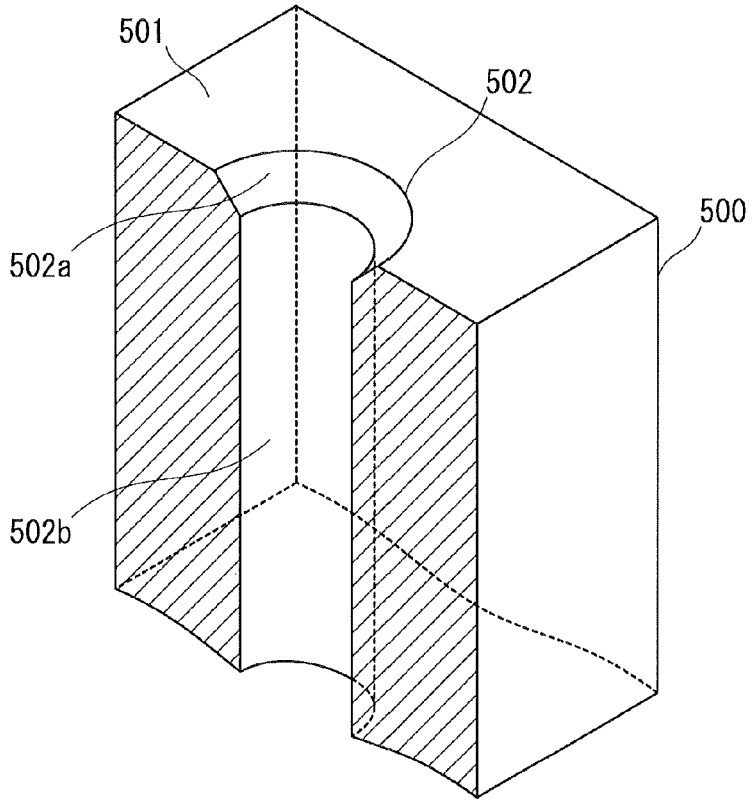
FIGS. 7A and 7B are views illustrating a shape of the hole of the fan frame according to the first embodiment.
Figure 7B:
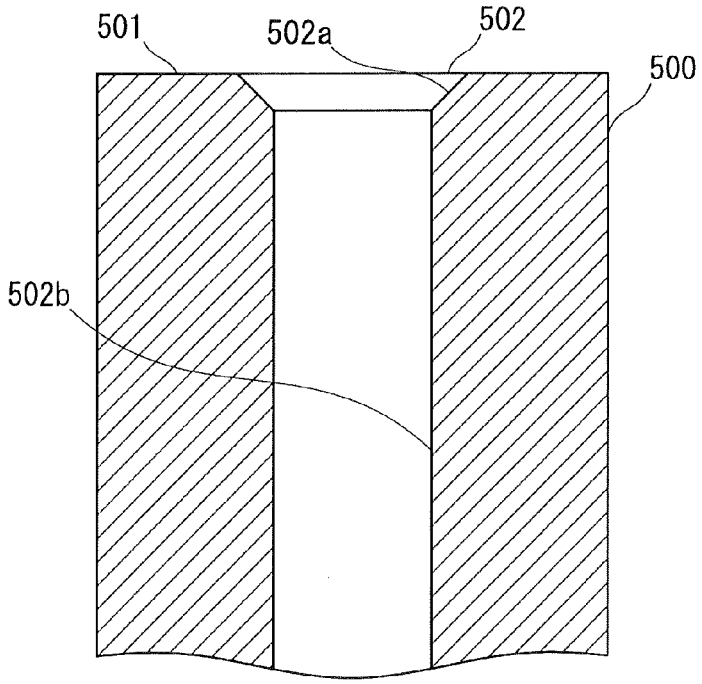

FIG. 1 is a perspective view illustrating the fan frame 1. FIG. 2 illustrates a cross section of the fan frame 1 of FIG. 1. FIG. 3 is an exploded perspective view illustrating a state in which the fan 100 is accommodated in the fan frame 1, a supporting member 200 is attached onto an attachment surface 10 of the fan frame 1, and a tapping screw 300 is fixed into the hole 20 of the fan frame 1 through the supporting member 200. FIG. 4 illustrates a cross section of the fan frame 1 and so on of FIG. 3. FIG. 5 is an enlarged view of an assembled state of the fan frame 1 and so on of FIG. 4. FIG. 6 is a side view illustrating a cross section of a state in which the tapping screw 300 is fixed into the hole 20 of the fan frame 1 through the supporting member 200. FIGS. 7A and 7B are views illustrating a shape of a hole of the fan frame 1, FIG. 7A is a perspective view illustrating a cross section of the shape of the hole, and FIG. 7B is a side view illustrating a cross section of the shape of the hole.

As illustrated in FIG. 1, the fan frame 1 is formed into a rectangular solid shape, for example, and has the attachment surface 10 onto which the supporting member 200 is attached. As illustrated in FIGS. 3 to 5, the four corners of the attachment surface 10 each have the hole 20 into which the tapping screw 300 is fixed through an opening 210 of the supporting member 200. The tapping screw 300 corresponds to a fixing member. The fan frame 1 has a shape corresponding to a complete rib shape in which the hole 20 is inserted through the entire region ranging from the attachment surface 10 to a surface facing the attachment surface 10. That is, as illustrated in FIG. 2, the single hole 20 is provided at each of the four corners of the attachment surface 10 of the fan frame 1 in a direction in which the tapping screw 300 is inserted through the hole 20.

As illustrated in FIGS. 2 and 4, the hole 20 has a first hole portion 20*a* opened in the attachment surface 10 and a second hole portion 20*b* extending from the first hole portion 20*a* and having a predetermined inner diameter. As illustrated in FIG. 2, the first hole portion 20*a* of the hole 20 is formed to have a diameter larger than that of the second hole portion 20*b* of the hole 20. As illustrated in FIGS. 2 and 4, the attachment surface 10 has at its center a hole into which the fan 100 for blowing air or cooling is accommodated. The hole has at its lower portion a placing surface 30 fixing the fan 100 with an adhesive or the like.

A tip end of the tapping screw 300 illustrated in FIG. 6 is inserted through the first hole portion 20*a* of the hole 20 of the attachment surface 10 at an angle defining a normal direction with the attachment surface 10 of the fan frame 1 through an opening 210 of the supporting member 200. A tip end of a tapping screw 300' illustrated by a broken line in FIG. 6 is inserted through the first hole portion 20*a* of the hole 20 of the attachment surface 10 at an angle inclined from the normal direction of the attachment surface 10 of the fan frame 1 through the opening 210 of the supporting member 200. The angle of the tapping screw 300' is corrected to the angle defining the normal direction with the attachment surface 10 of the fan frame 1 by the inclining first hole portion 20*a*, and thereafter the tapping screw 300' is fixed into the second hole portion 20*b* of the hole 20 of the attachment surface 10.

FIG. 7 illustrates a hole 502 provided in an attachment surface 501 in a hole formation portion 500 provided at each of the four corners of the fan frame 1. The hole 502 has a first hole portion 502*a* opened in the attachment surface 501 and a second hole portion 502*b* extending from the first hole portion 502*a* and having a predetermined inner diameter. That is, the hole 502 of the attachment surface 501 of the hole formation portion 500 illustrated in FIG. 7 corresponds to the hole 20 provided at each of the four corners of the attachment surface 10 of the fan frame 1 illustrated in FIG. 2. FIG. 7 is used for ease of contrast with application examples 1 to 9 to be described later with reference to FIGS. 8 to 17.

Next, the shape of the hole of the fan frame 1 according to the application examples 1 to 9 of the first embodiment will be sequentially described with reference to FIGS. 8 to 17.

Figure 8A:
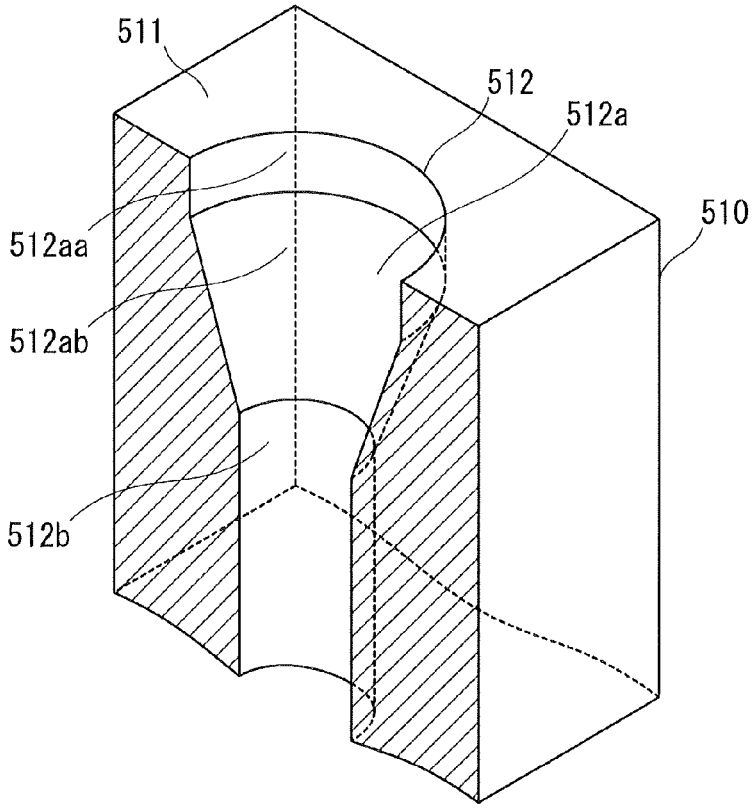
FIGS. 8A and 8B are views illustrating a shape of a hole of a fan frame according to an application example 1 of the first embodiment.
Figure 8B:
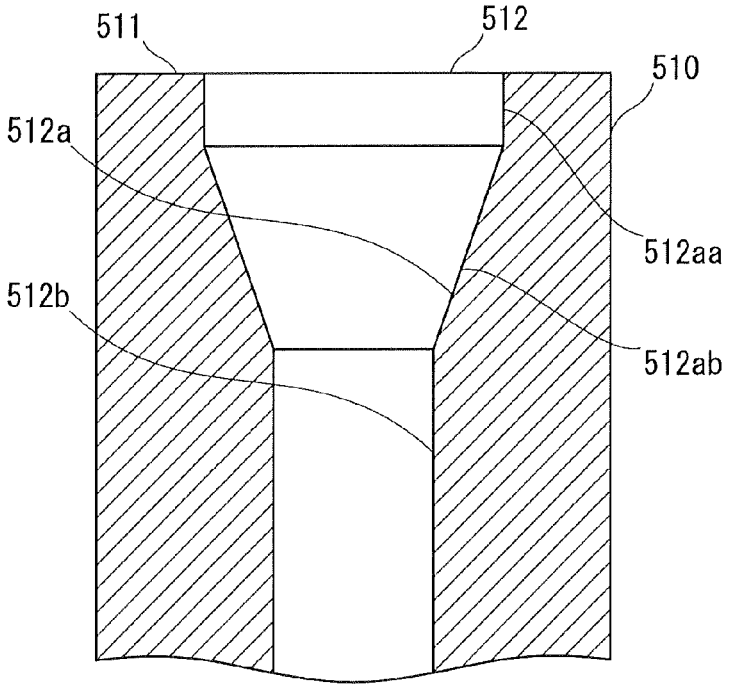
Figure 9:
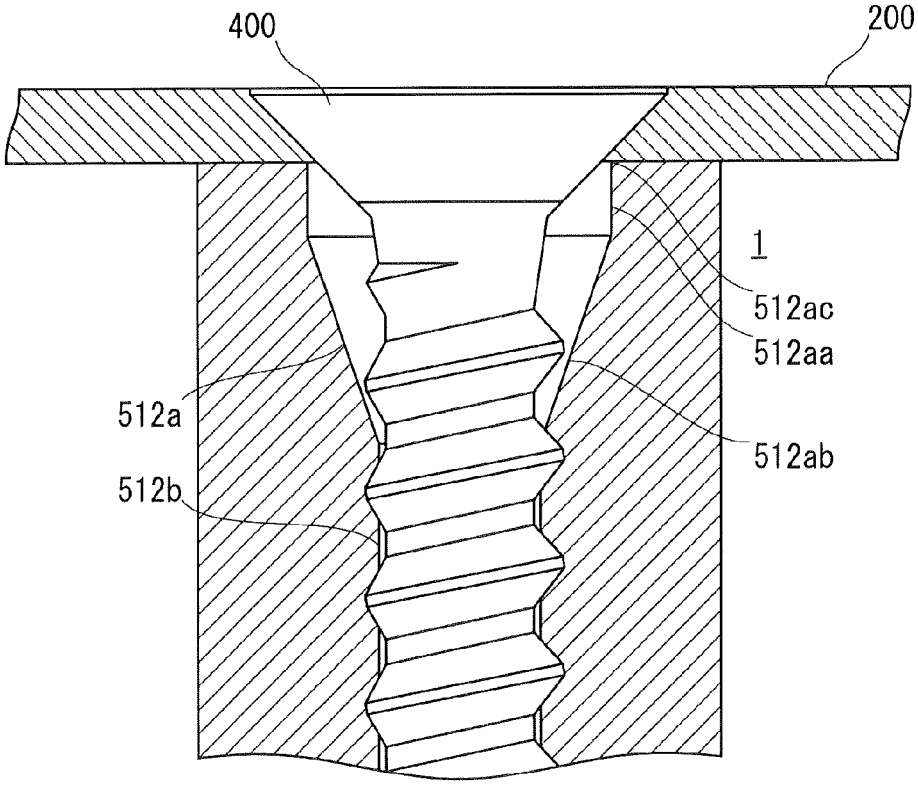
FIG. 9 is a side view illustrating a cross section of a state in which a flat countersunk head screw is fixed into the hole of the fan frame according to the application example 1 of the first embodiment.

As illustrated in FIGS. 8 and 9, in the hole formation portion 510 provided at each of the four corners of the fan frame 1 according to the application example 1, a first hole portion 512*a* of a hole 512 opened in an attachment surface 511 is constituted of a rectilinear portion 512*aa* and an inclining portion 512*ab*. The rectilinear portion 512*aa* of the first hole portion 512*a* is formed to have a constant diameter in the axis direction toward a second hole portion 512*b*. The inclining portion 512*ab* of the first hole portion 512*a* extends from the rectilinear portion 512*aa* and is linearly inclined to be reduced in diameter toward the second hole portion 512*b*. As illustrated in FIG. 9, an orthogonal portion 512*ac* of the first hole portion 512*a* corresponds to a root portion of the rectilinear portion 512*aa* of the first hole portion 512*a* and is perpendicular to the supporting member 200.

Figure 10A:
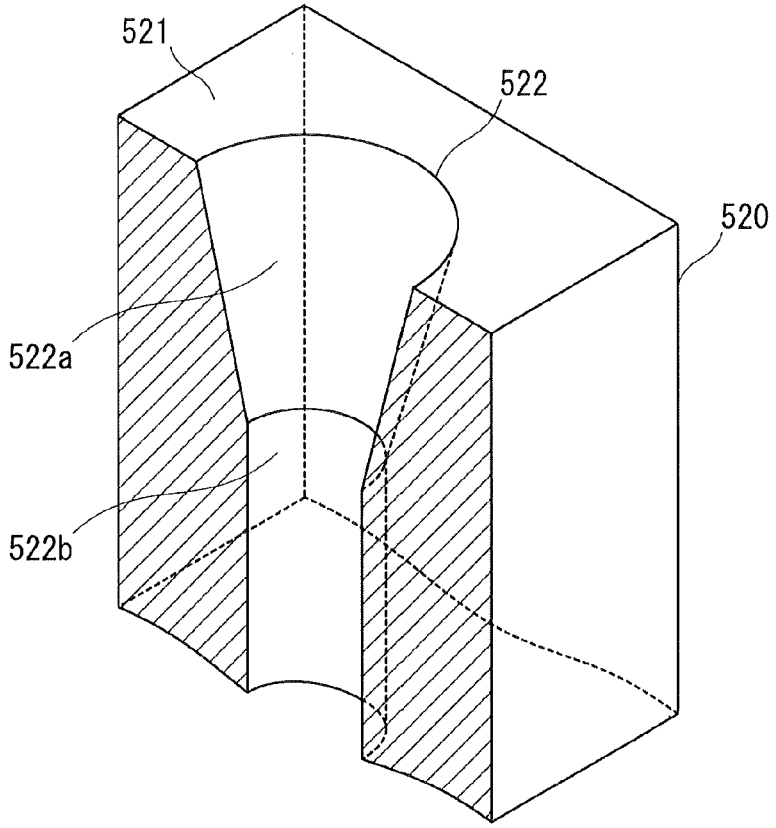
FIGS. 10A and 10B are views illustrating a shape of a hole of a fan frame according to an application example 2 of the first embodiment.
Figure 10B:
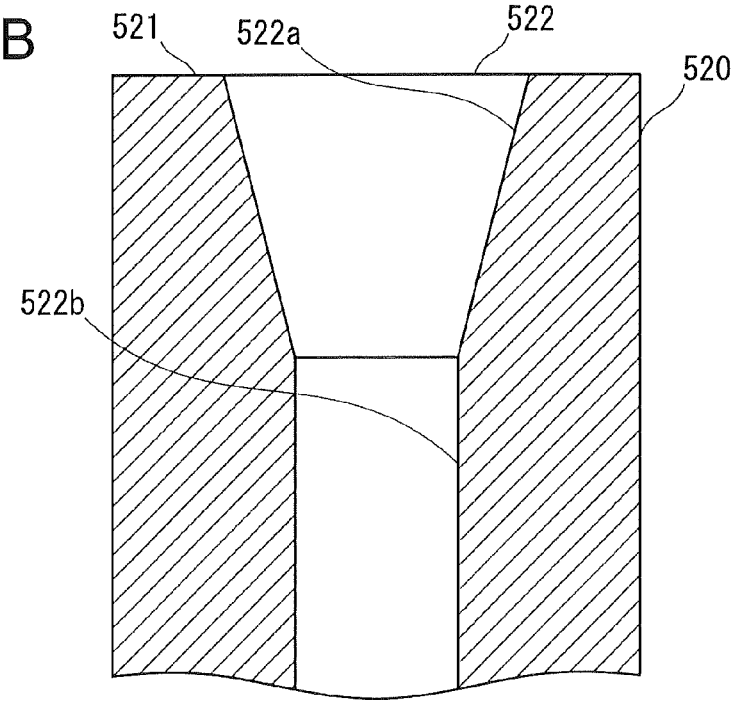

As illustrated in FIG. 10, in a hole formation portion 520 provided at each of the four corners of the fan frame 1 according to the application example 2, a first hole portion 522*a* of a hole 522 opened in an attachment surface 521 is linearly inclined to be reduced in diameter toward a second hole portion 522*b*.

Figure 11A:
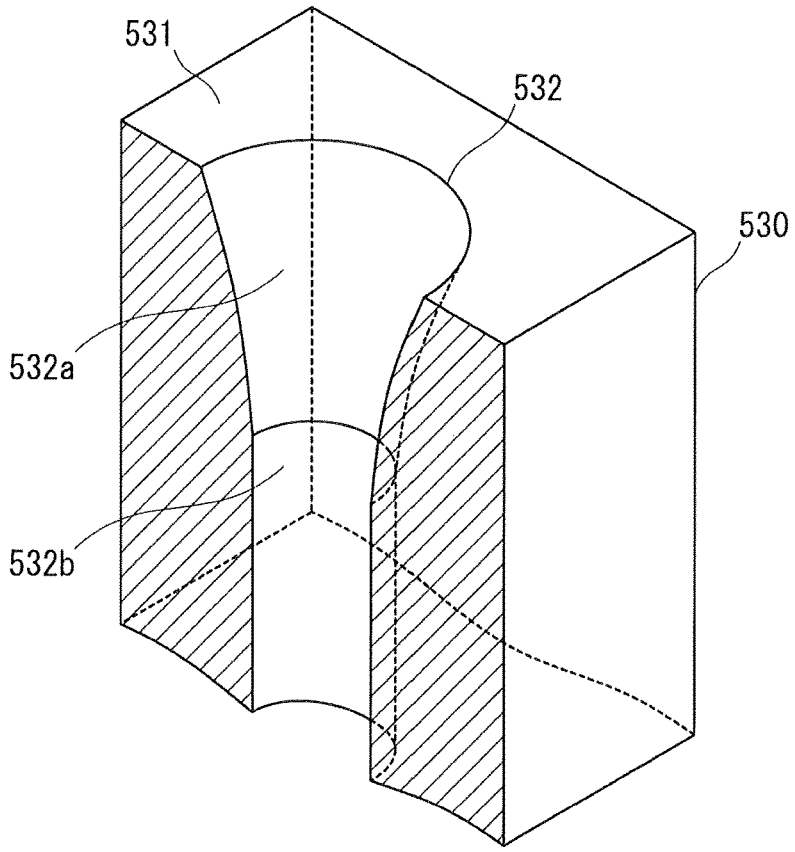
FIGS. 11A and 11B are views illustrating a shape of a hole of a fan frame according to an application example 3 of the first embodiment.
Figure 11B:
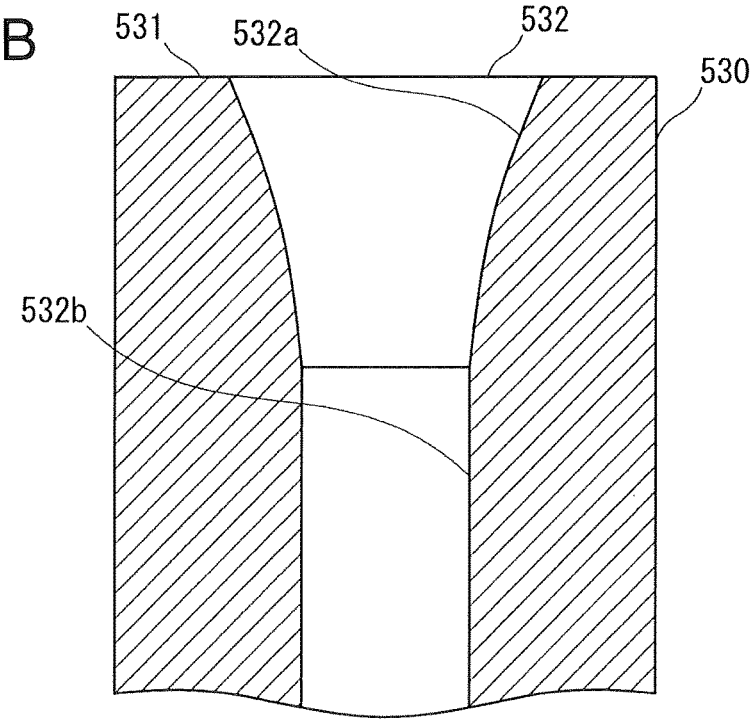

As illustrated in FIG. 11, in a hole formation portion 530 provided at each of the four corners of the fan frame 1 according to the application example 3, a first hole portion 532*a* of a hole 532 opened in an attachment surface 531 is reduced in diameter toward a second hole portion 532*b* and, at the same time, curved convexly inward the axis direction toward the second hole portion 532*b*.

Figure 12A:
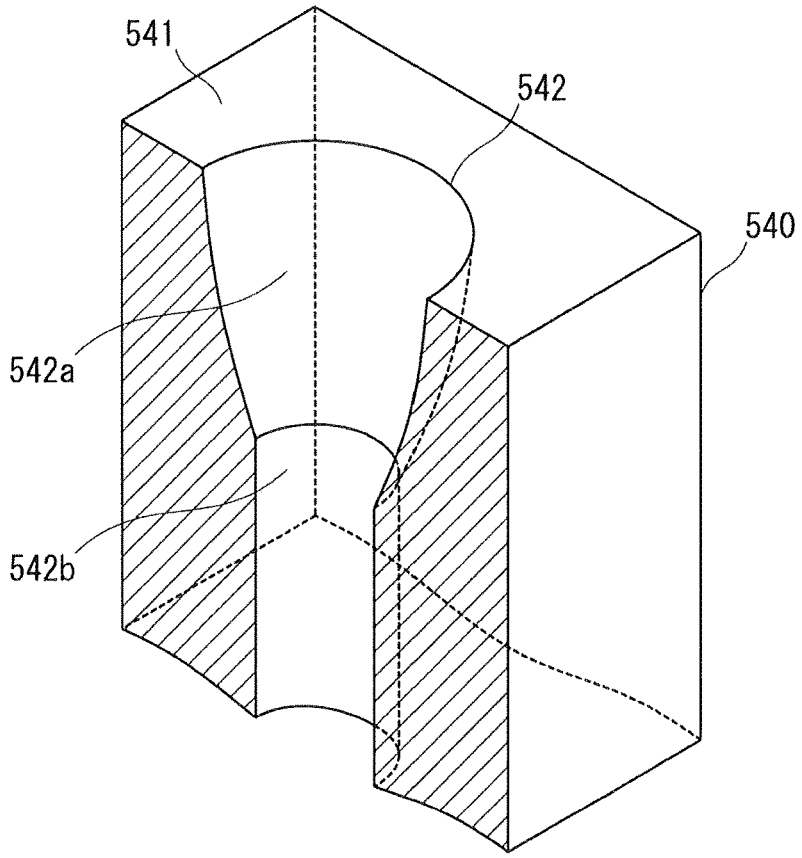
FIGS. 12A and 12B are views illustrating a shape of a hole of a fan frame according to an application example 4 of the first embodiment.
Figure 12B:
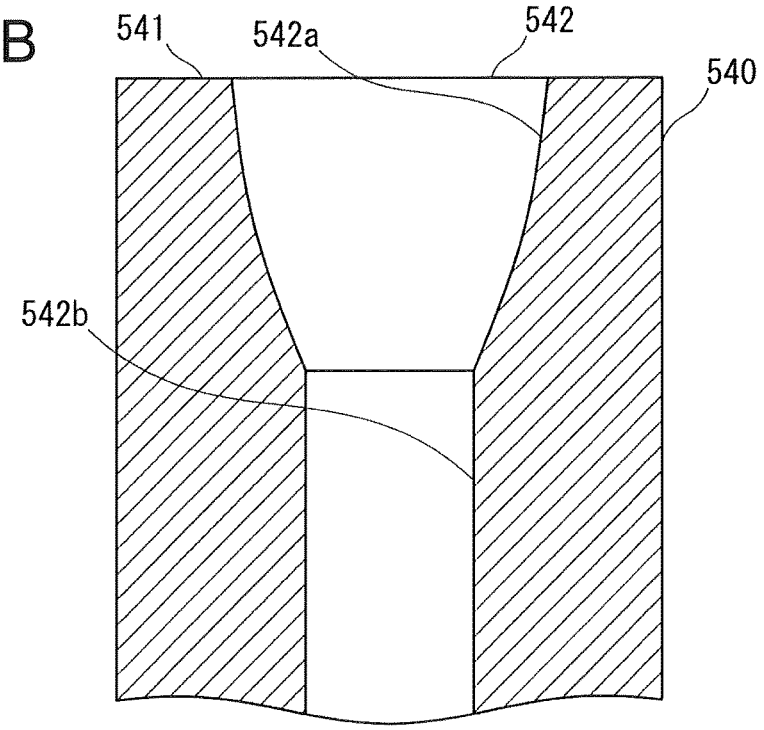

As illustrated in FIG. 12, in a hole formation portion 540 provided at each of the four corners of the fan frame 1 according to the application example 4, a first hole portion 542*a* of a hole 542 opened in an attachment surface 541 is reduced in diameter toward a second hole portion 542*b* and, at the same time, curved concavely outward the axis direction toward the second hole portion 542*b*.

Figure 13A:
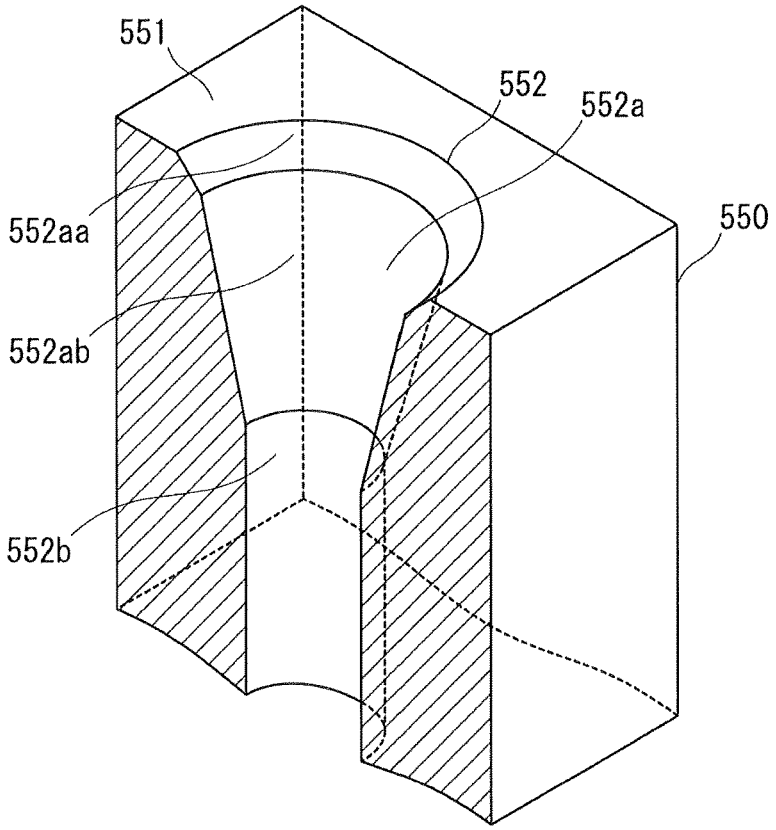
FIGS. 13A and 13B are views illustrating a shape of a hole of a fan frame according to an application example 5 of the first embodiment.
Figure 13B:
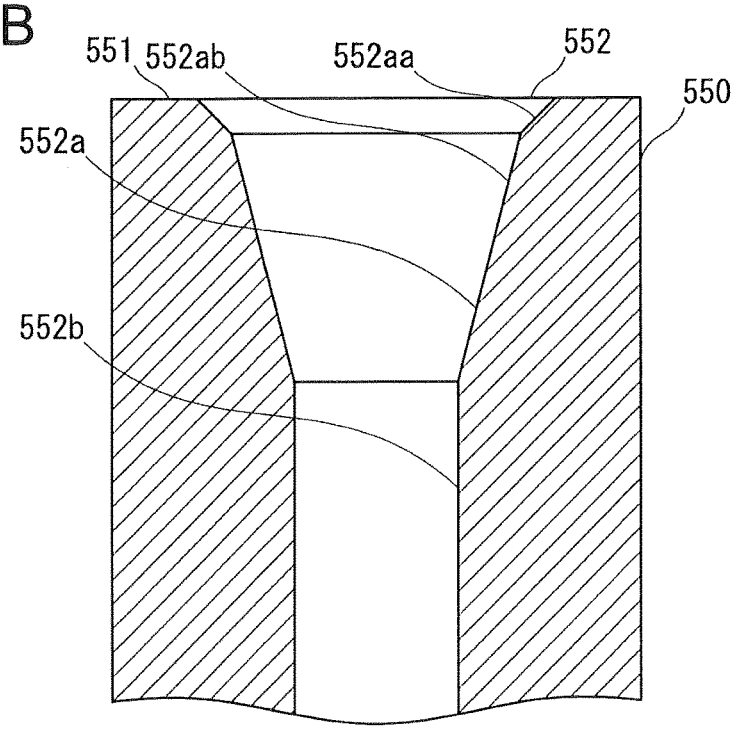

As illustrated in FIG. 13, in a hole formation portion 550 provided at each of the four corners of the fan frame 1 according to the application example 5, a first hole portion 552*a* of a hole 552 opened in an attachment surface 551 is constituted of a first inclining portion 552*aa* and a second inclining portion 552*ab*. The first inclining portion 552*aa* of the first hole portion 552*a* is linearly inclined to be reduced in diameter. The second inclining portion 552*ab* of the first hole portion 552*a* extends from the first inclining portion 552*aa* and is linearly inclined to be further reduced in diameter toward the second hole portion 552*b*.

Figure 14A:
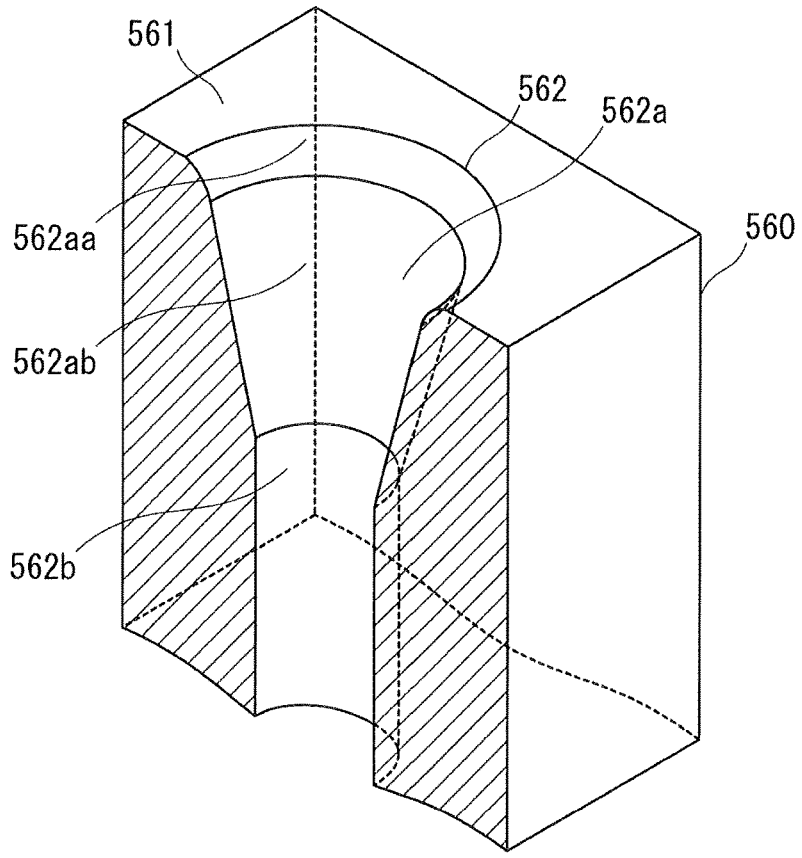
FIGS. 14A and 14B are views illustrating a shape of a hole of a fan frame according to an application example 6 of the first embodiment.
Figure 14B:
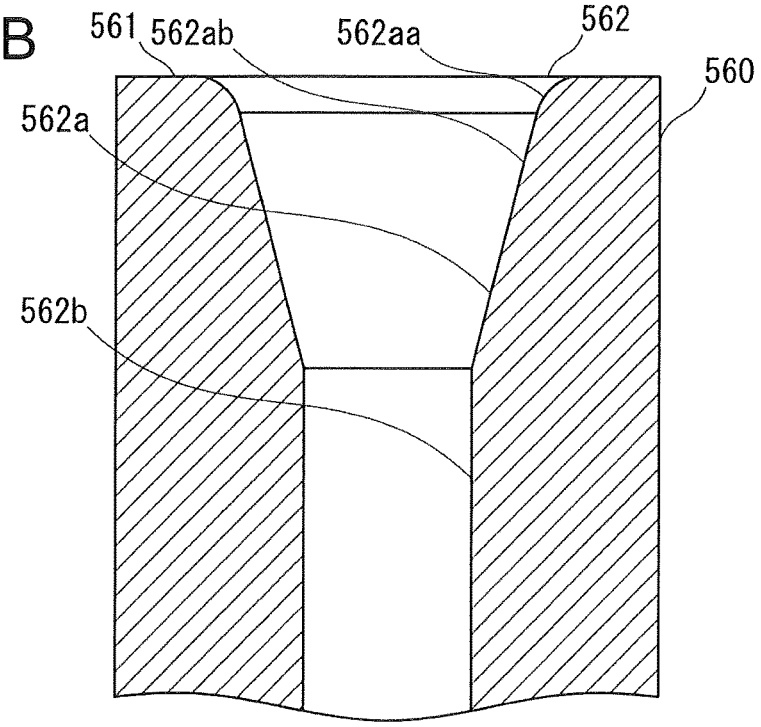

As illustrated in FIG. 14, in a hole formation portion 560 provided at each of the four corners of the fan frame 1 according to the application example 6, a first hole portion 562*a* of a hole 562 opened in an attachment surface 561 is constituted of a convex portion 562*aa* and an inclining portion 562*ab*. The convex portion 562*aa* of the first hole portion 562*a* is reduced in diameter toward the second hole portion 562*b* and, at the same time, curved convexly inward the axis direction toward the second hole portion. The inclining portion 562*ab* of the first hole portion 562*a* extends from the convex portion 562*aa* and is linearly inclined to be further reduced in diameter toward the second hole portion 562*b*.

Figure 15A:
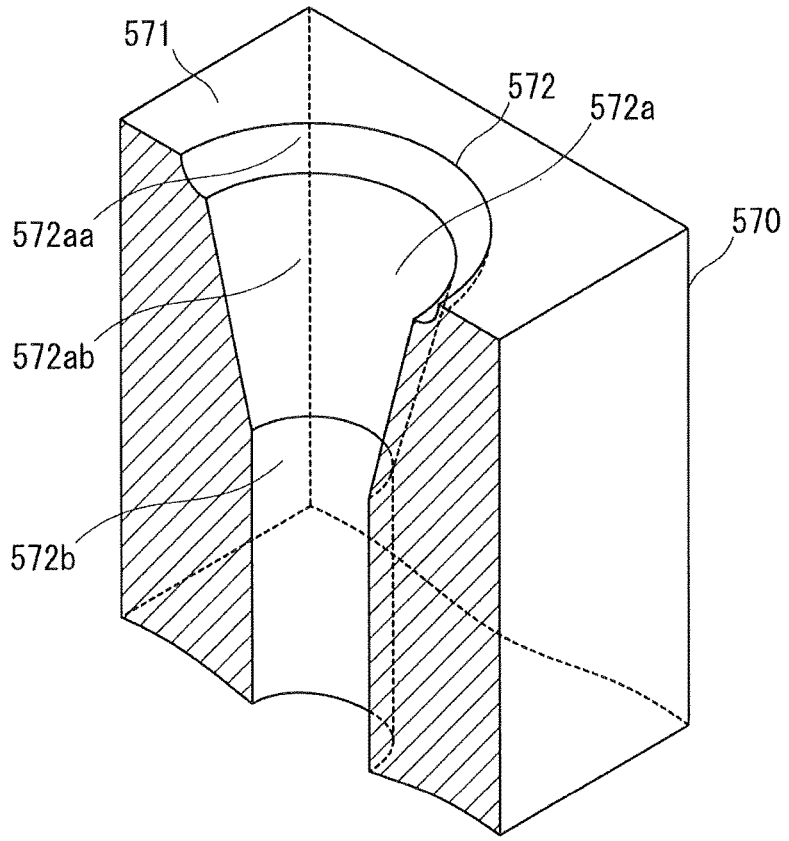
FIGS. 15A and 15B are views illustrating a shape of a fan frame according to an application example 7 of the first embodiment.
Figure 15B:
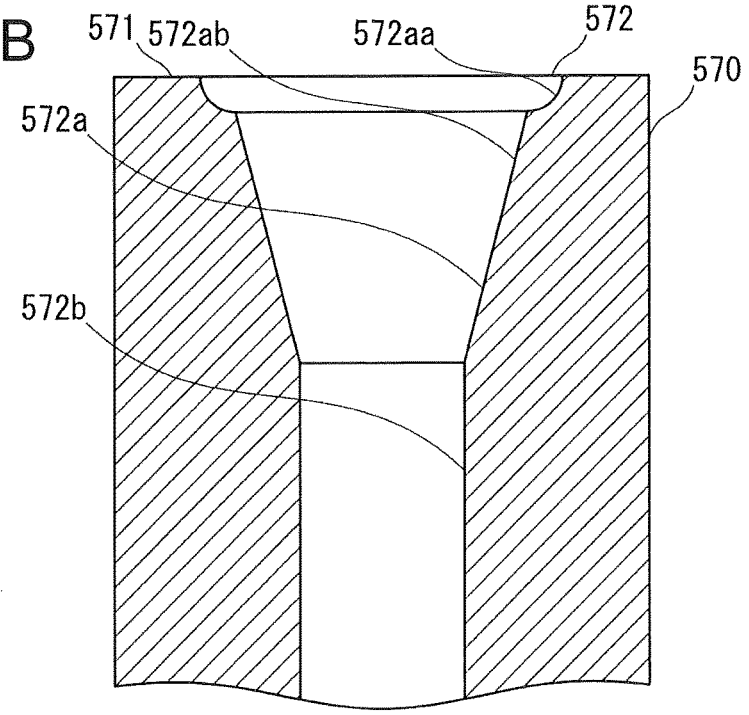

As illustrated in FIG. 15, in a hole formation portion 570 provided at each of the four corners of the fan frame 1 according to the application example 7, a first hole portion 572*a* of a hole 572 opened in an attachment surface 571 is constituted of a convex portion 572*aa* and an inclining portion 572*ab*. The convex portion 572*aa* of the first hole portion 572*a* is reduced in diameter toward the second hole portion 572*b* and, at the same time, curved convexly outward the axis direction toward the second hole portion 572*b*. The inclining portion 572*ab* of the first hole portion 572*a* extends from the concave portion 572*aa* and is linearly inclined to be further reduced in diameter toward the second hole portion 572*b*.

Figure 16A:
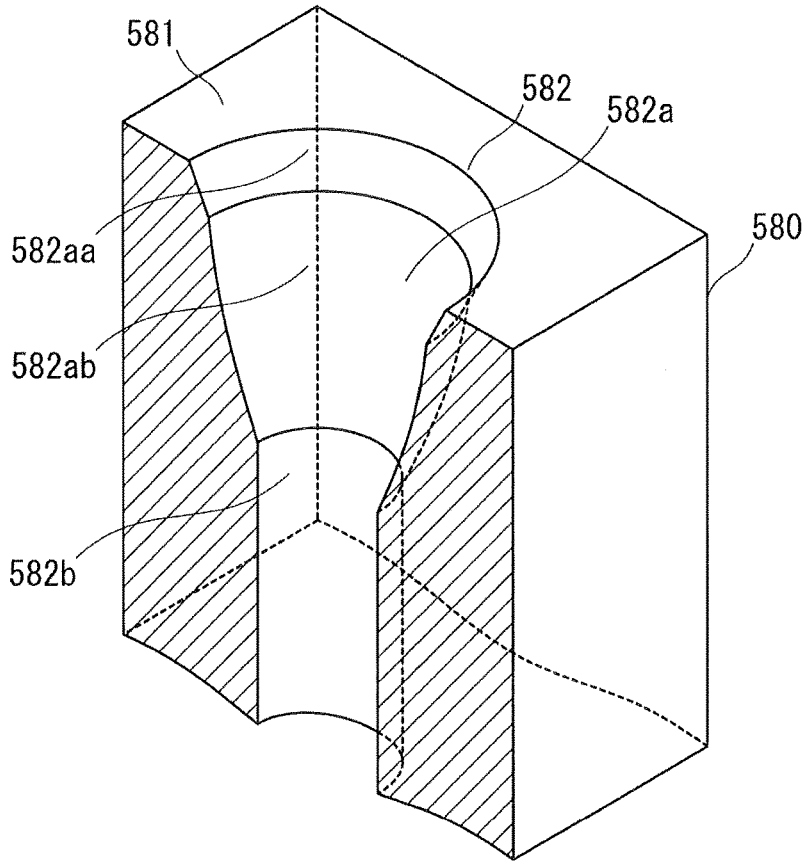
FIGS. 16A and 16B are views illustrating a shape of a hole of a fan frame according to an application example 8 of the first embodiment.
Figure 16B:
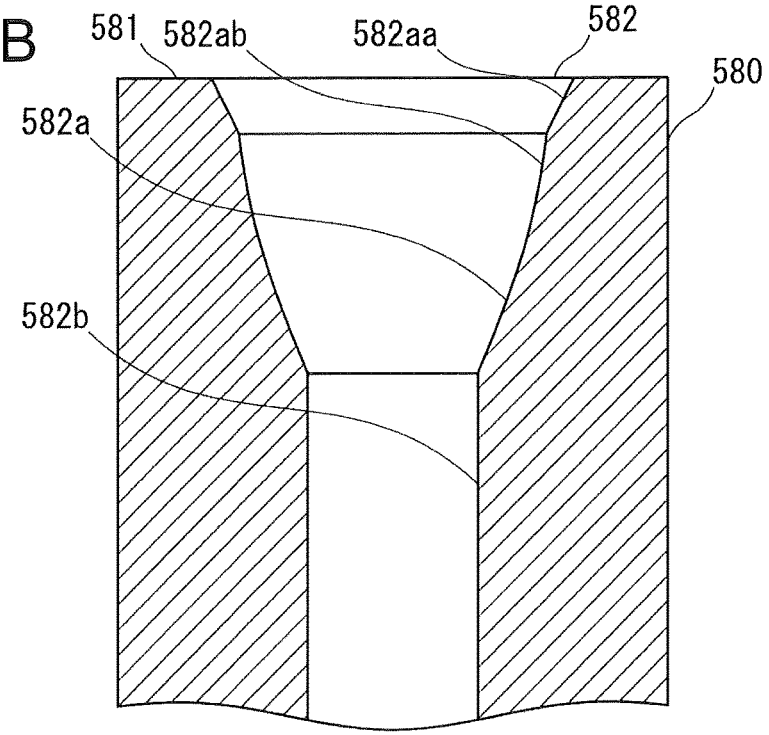

As illustrated in FIG. 16, in a hole formation portion 580 provided at each of the four corners of the fan frame 1 according to the application example 8, a first hole portion 582*a* of a hole 582 opened in an attachment surface 581 is constituted of an inclining portion 582*aa* and a concave portion 582*ab*. The inclining portion 582*aa* of the first hole portion 582*a* is linearly inclined to be reduced in diameter toward a second hole portion 582*b*. The concave portion 582*ab* of the first hole portion 582*a* extends from the inclining portion 582*aa*, is further reduced in diameter toward the second hole portion 582*b*, and is curved concavely outward the axis direction toward the second hole portion 582*b*.

Figure 17A:
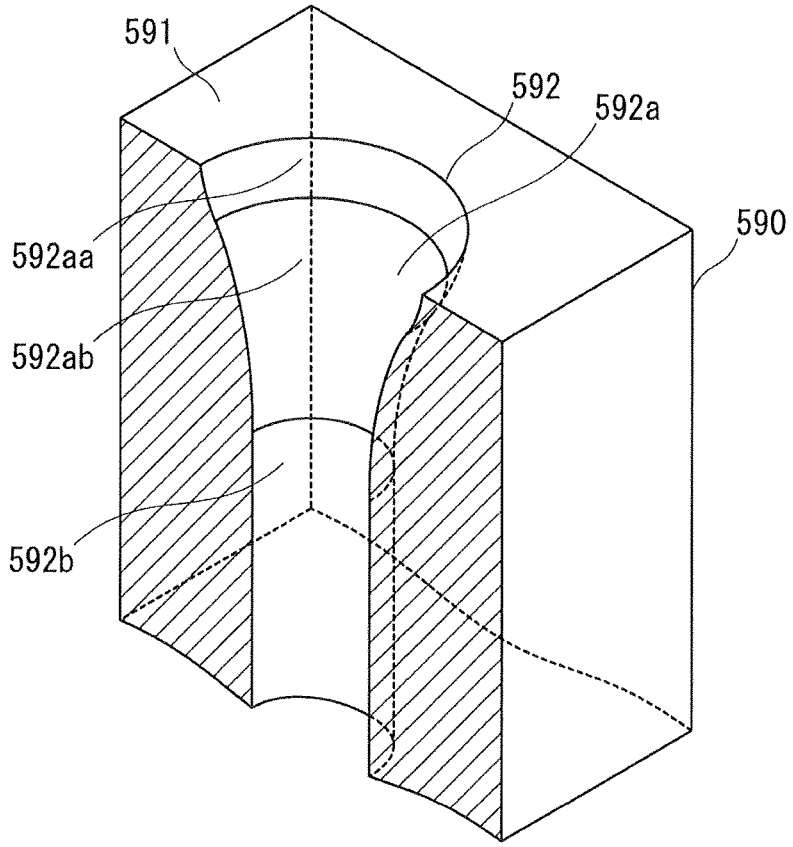
FIGS. 17A and 17B are views illustrating a shape of a hole of a fan frame according to an application example 9 of the first embodiment.
Figure 17B:
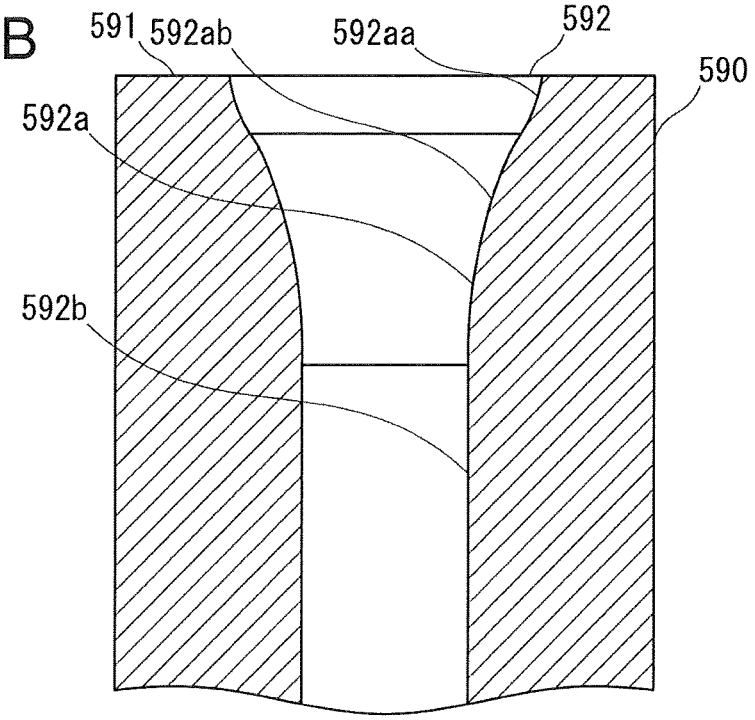

As illustrated in FIG. 17, in a hole formation portion 590 provided at each of the four corners of the fan frame 1 according to the application example 9, a first hole portion 592*a* of a hole 592 opened in an attachment surface 591 is constituted of a concave portion 592*aa* and a convex portion 592*ab*. The concave portion 592*aa* of the first hole portion 592*a* is reduced in diameter toward the second hole portion 592*b* and, at the same time, curved concavely outward the axis direction toward the second hole portion 592*b*. The convex portion 592*ab* of the first hole portion 592*a* extends from the concave portion 592*aa*, is further reduced in diameter toward the second hole portion 592*b*, and is curved convexly inward the axis direction toward the second hole portion 592*b*.

Second Embodiment

As in the fan frame 1 according to the first embodiment, a fan frame 2 according to a second embodiment accommodates a fan 100 for blowing air or cooling and has holes 50 and 70 into which a tapping screw 300 is fixed. The fan frame 2 according to the second embodiment corresponds to an open rib shape having a space in a region ranging from an attachment surface 40 to an attachment surface 60 facing the attachment surface 40. The fan frame 2 according to the second embodiment will be specifically described with reference to FIGS. 18 to 23.

The shape and so on of the holes 50 and 70 of the fan frame 2 of the second embodiment will be sequentially described with reference to FIGS. 18 to 23.

Figure 18:
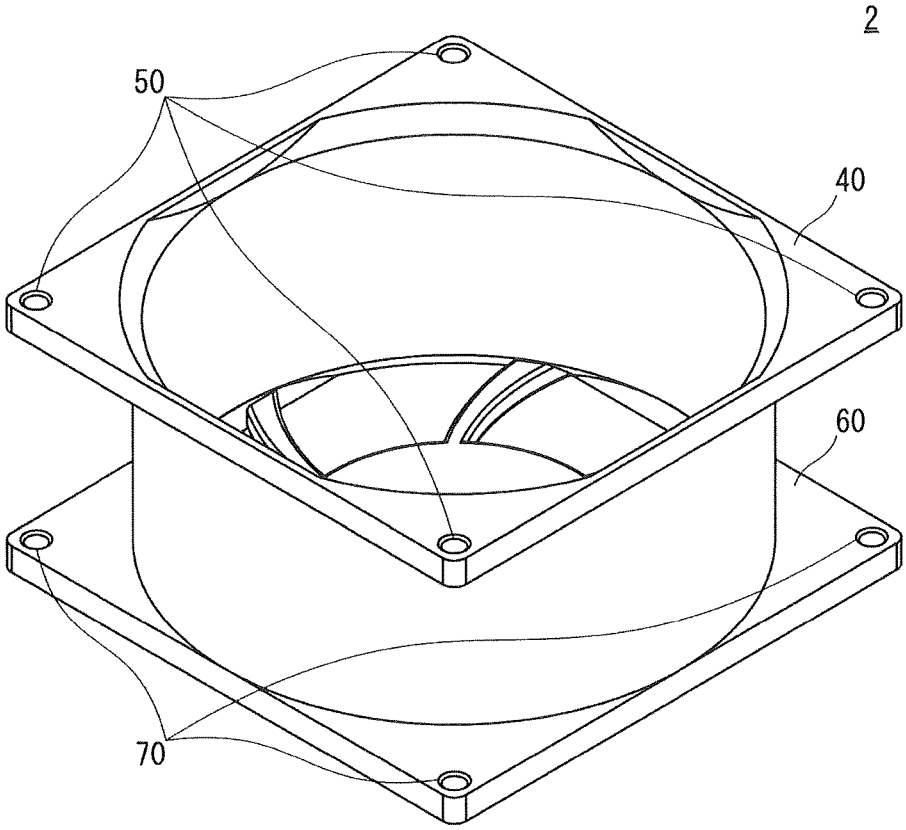
FIG. 18 is a perspective view illustrating a fan frame according to a second embodiment.
Figure 19:
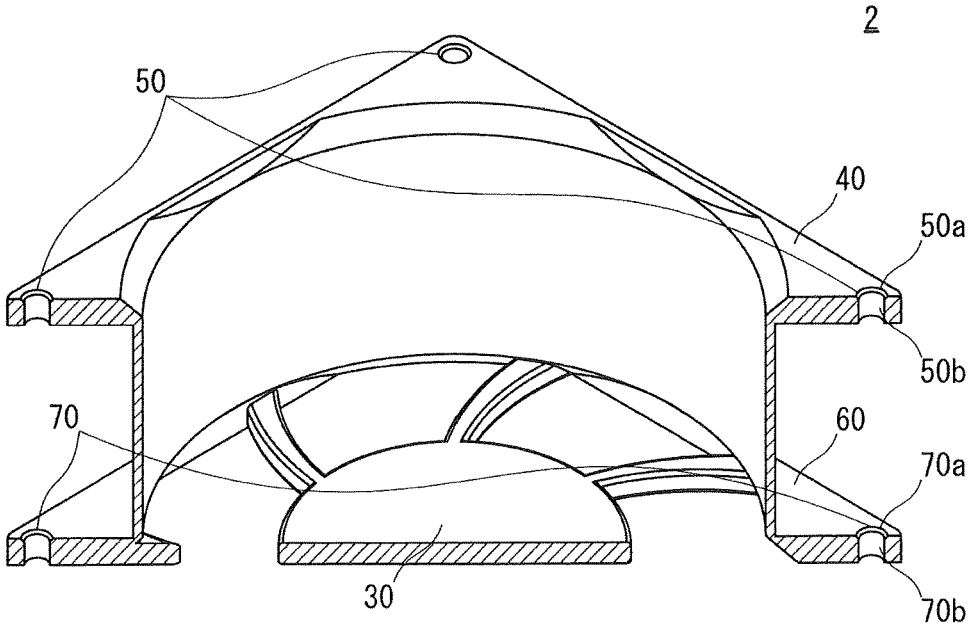
FIG. 19 is a perspective view illustrating a cross section of the fan frame according to the second embodiment.
Figure 20:
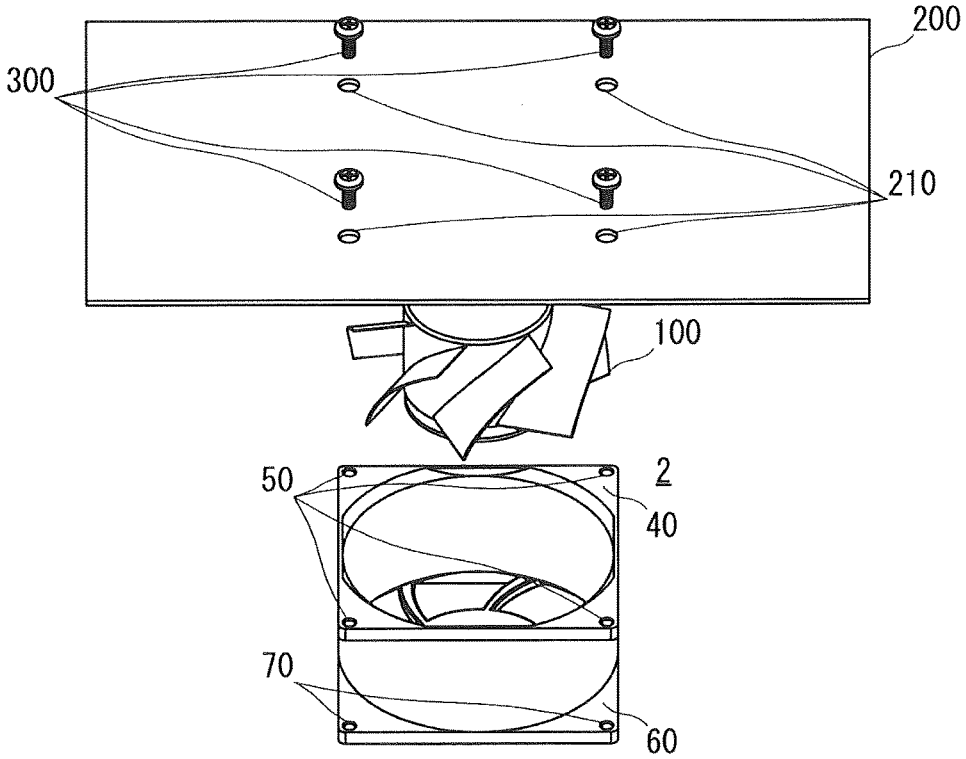
FIG. 20 is an exploded perspective view illustrating a state in which a fan is accommodated in the fan frame according to the second embodiment, a supporting member is attached onto an attachment surface of the fan frame, and a tapping screw is fixed into a hole of the fan frame through the supporting member.
Figure 21:
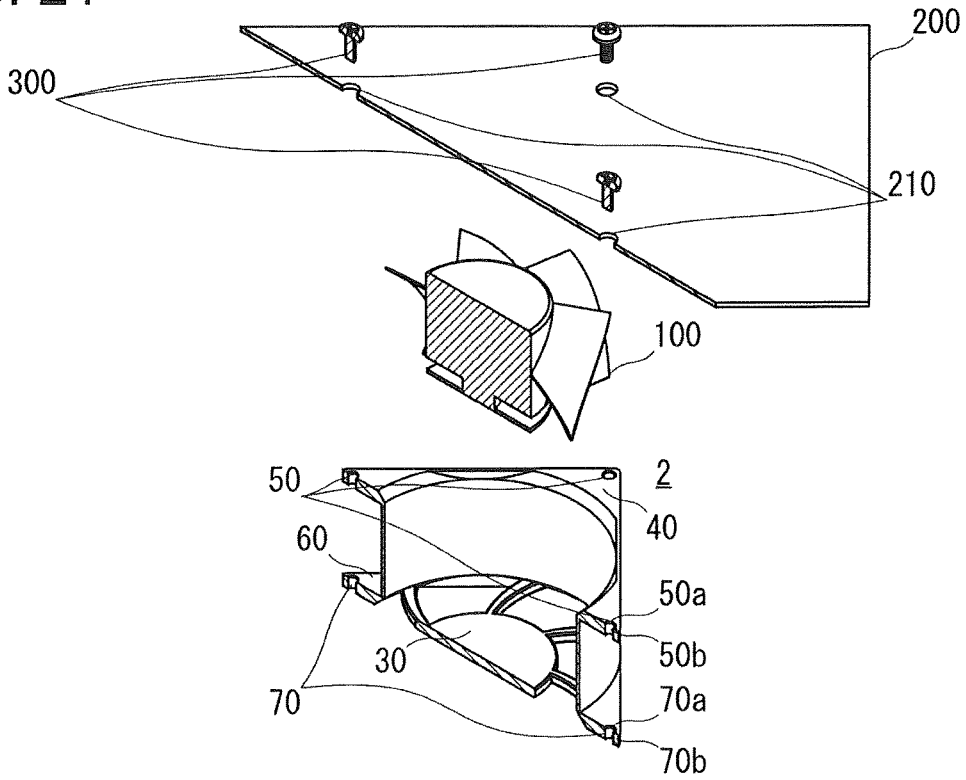
FIG. 21 is an exploded perspective view illustrating a cross section of the state in which the fan is accommodated in the fan frame according to the second embodiment, the supporting member is attached onto the attachment surface of the fan frame, and the tapping screw is fixed into the hole of the fan frame through the supporting member.
Figure 22:
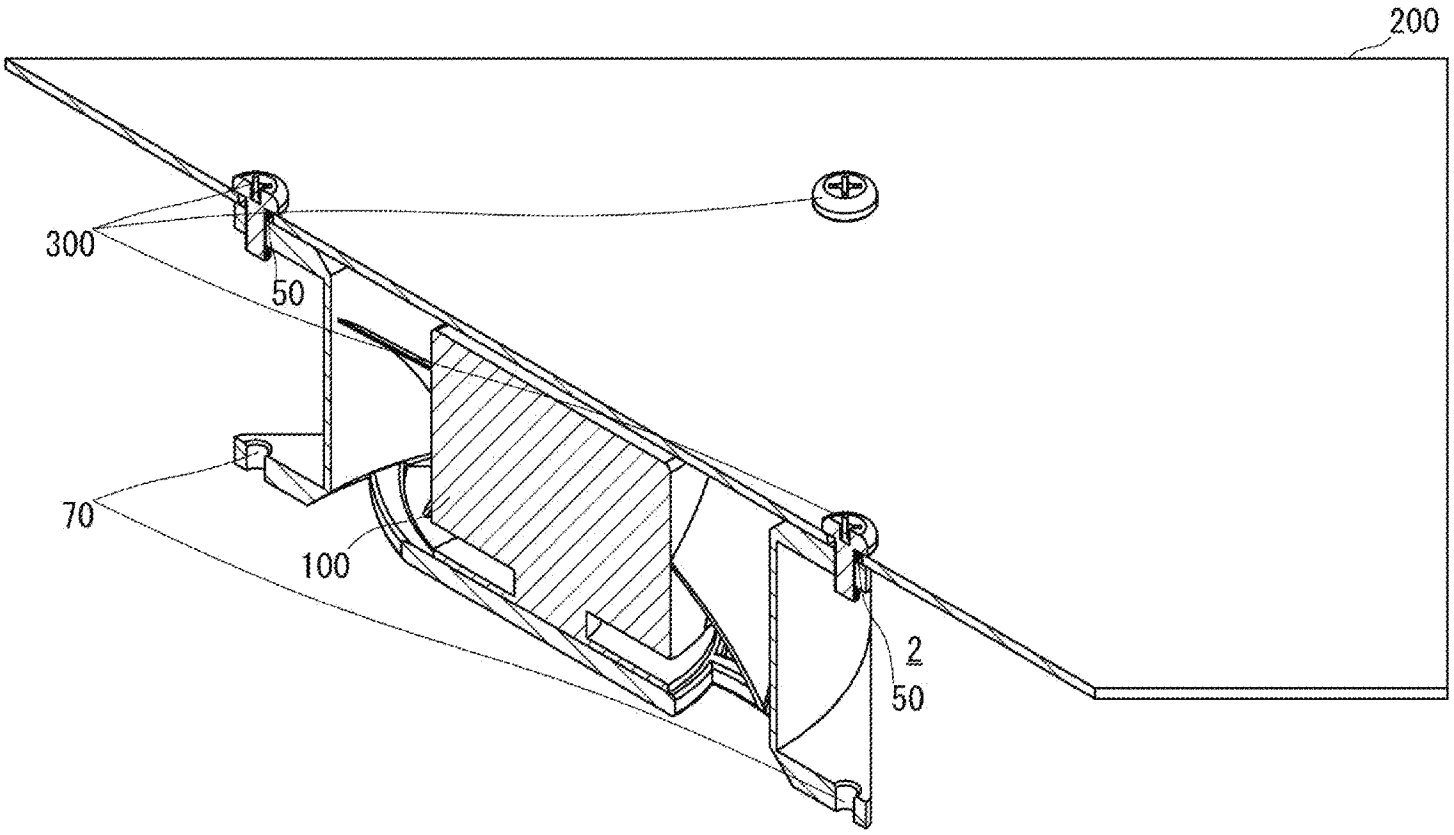
FIG. 22 is a perspective view illustrating a cross section of the state in which the fan is accommodated in the fan frame according to the second embodiment, the supporting member is attached onto the attachment surface of the fan frame, and the tapping screw is fixed into the hole of the fan frame through the supporting member.
Figure 23A:
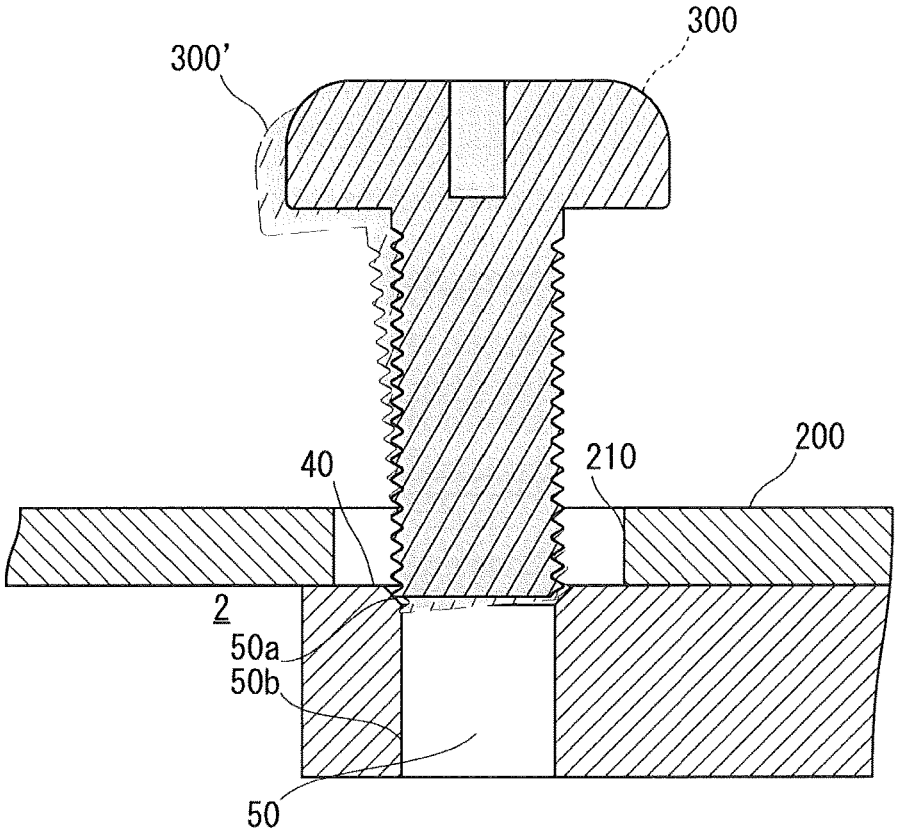
FIG. 23A is a side view illustrating a cross section of a state in which only a tip end of the tapping screw is inserted through the hole.
Figure 23B:
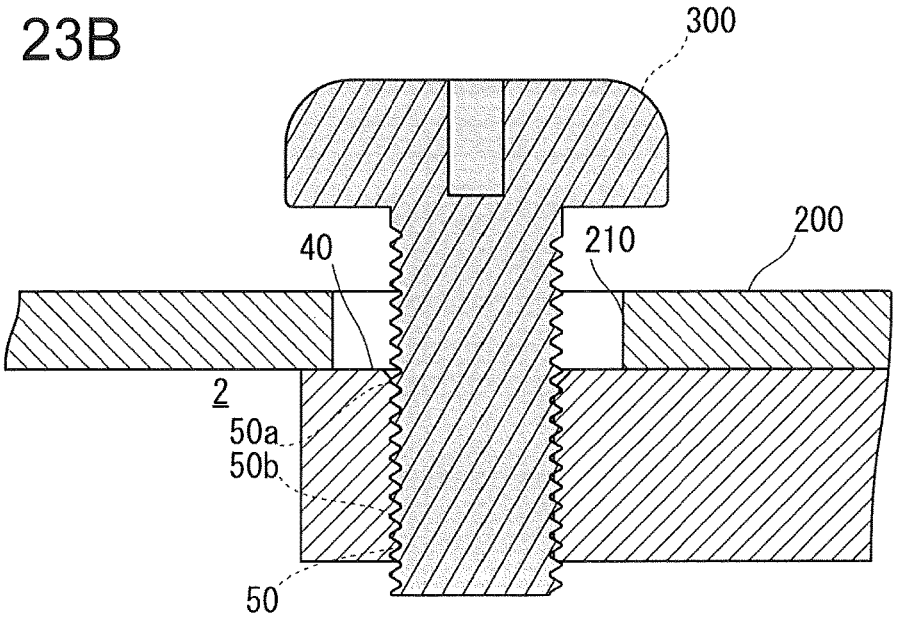
FIG. 23B is a side view illustrating a cross section of a state in which the tapping screw is inserted through the hole.

FIG. 18 is a perspective view illustrating the fan frame 2. FIG. 19 illustrates a cross section of the fan frame 2 of FIG. 18. FIG. 20 is an exploded perspective view illustrating a state in which the fan 100 is accommodated in the fan frame 2, a supporting member 200 is attached to an attachment surface 40 of the fan frame 2, and a tapping screw 300 is fixed into the hole 50 of the fan frame 2 through the supporting member 200. FIG. 21 illustrates a cross section of the fan frame 2 and so on of FIG. 20. FIG. 22 is an enlarged view of an assembled state of the fan frame 2 and so on of FIG. 21. FIGS. 23A and 23B are side views illustrating a cross section of a state in which the tapping screw 300 is fixed into the hole 50 of the fan frame 2 through the supporting member 200, FIG. 23A illustrates a state in which only a tip end of the tapping screw 300 is inserted through the hole 50, and FIG. 23B illustrates a state in which the tapping screw 300 is inserted through the hole 50.

As illustrated in FIG. 18, the fan frame 2 is formed into a rectangular solid shape, for example, and has the attachment surface 40 to which the supporting member 200 is attached. As illustrated in FIGS. 20 to 22, the four corners of the attachment surface 40 each have the hole 50 into which the tapping screw 300 is fixed through an opening 210 of the supporting member 200. The fan frame 2 has a shape corresponding to an open rib shape having a space in the region ranging from the attachment surface 40 to the attachment surface 60 facing the attachment surface 40. As illustrated in FIGS. 20 to 22, the hole 70 is provided at each of the four corners of the attachment surface 60. That is, as illustrated in FIG. 19, with regard to the holes 50 and 70, the single hole is provided at each of the four corners of the fan frame 2 in a direction in which the tapping screw 300 is inserted through the hole.

As illustrated in FIGS. 19 and 21, the hole 50 has a first hole portion 50*a* opened in the attachment surface 40 and a second hole portion 50*b* extending from the first hole portion 50*a* and having a predetermined inner diameter. As illustrated in FIG. 19, the first hole portion 50*a* of the hole 50 is formed to have a diameter larger than that of the second hole portion 50*b* of the hole 50. Similarly, as illustrated in FIGS. 19 and 21, the hole 70 has a first hole portion 70*a* opened in the attachment surface 60 and a second hole portion 70*b* extending from the first hole portion 70*a* and having a predetermined inner diameter. As illustrated in FIG. 19, the first hole portion 70*a* of the hole 70 is formed to have a diameter larger than that of the second hole portion 70*b* of the hole 70.

A tip end of the tapping screw 300 illustrated in FIG. 23A is inserted through the first hole portion 50*a* of the hole 50 of the attachment surface 40 at an angle defining a normal direction with the attachment surface 40 of the fan frame 2 through the opening 210 of the supporting member 200. A tip end of the tapping screw 300' illustrated by a broken line in FIG. 23A is inserted through the first hole portion 50*a* of the hole 50 of the attachment surface 40 at an angle inclined from the normal direction of the attachment surface 40 of the fan frame 2 through the opening 210 of the supporting member 200. The angle of the tapping screw 300' is corrected to the angle defining the normal direction with the attachment surface 40 of the fan frame 2 by the first hole portion 50*a*, and thereafter the tapping screw 300' is fixed into the second hole portion 50*b* of the hole 50 of the attachment surface 40. The tapping screw 300 illustrated in FIG. 23B is inserted through the first hole portion 50*a* of the hole 50 of the attachment surface 40 at an angle defining a normal direction with the attachment surface 40 of the fan frame 2 through the opening 210 of the supporting member 200.

The shapes of the hole of the fan frame 1 according to the application examples 1 to 9 of the first embodiment described with reference to FIGS. 8 to 17 can be applied to the shapes of the holes 50 and 70 of the fan frame 2 of the second embodiment.

The first and second embodiments provide the following effects.

(1) The fan frame has the hole 20 having the first hole portion 20*a* and the second hole portion 20*b*, and the first hole portion 20*a* opened in the attachment surface 10 onto which the supporting member 200 is attached is formed to have a diameter larger than that of the second hole portion 20*b* extending from the first hole portion 20*a*; therefore, the hole 20 into which the tapping screw 300 is fixed is not damaged by the tapping screw 300, and the assembly process can be simplified.

(2) The rectilinear portion 512*aa* of the first hole portion 512*a* of the hole 512 opened in the attachment surface 511 of FIG. 8 is formed to have a constant diameter in the axis direction toward the second hole portion 512*b*. The inclining portion 512*ab* of the first hole portion 512*a* extends from the rectilinear portion 512*aa* and is linearly inclined to be reduced in diameter toward the second hole portion 512*b*. That is, in the hole 512, the rectilinear portion 512*aa* having a straight shape is provided from the attachment surface 511, and thereafter the inclining portion 512*ab* having a tapered shape is provided.

According to the hole 512, as illustrated in FIG. 9, the depth of the rectilinear portion 512*aa* having a straight shape is determined according to a distance from a screw head portion to a screw thread of the flat countersunk head screw 400, whereby the angle of the inclining portion 512*ab* can be kept constant regardless of the screw shape. The flat countersunk head screw 400 corresponds to a fixing member. According to the hole 512, as illustrated in FIG. 9, the orthogonal portion 512*ac* corresponding to a root portion of the rectilinear portion 512*aa* of the first hole portion 512*a* can be prevented from interfering with the flat countersunk head screw 400.

Further, according to the hole 512, when the flat countersunk head screw 400 is fixed into the hole 512, high torque is realized in a stepwise manner from the tapered inclining portion 512*ab*, and the torque can be kept constant at the straight second hole portion 512*b* having a straight shape. Accordingly, when the flat countersunk head screw 400 is tightened into the hole 512, stress applied to the hole 512 increases in a stepwise manner, and therefore, excessive stress can be prevented from being applied to the hole 512.

(3) The first hole portion 522*a* of the hole 522 opened in the attachment surface 521 of FIG. 10 is linearly inclined to be reduced in diameter toward the second hole portion 522*b*. That is, in the hole 522, the first hole portion 522*a* opened in the attachment surface 521 has a linear tapered shape. According to the hole 522, when the tapping screw 300 is fixed into the hole 522, the engagement amount of the screw thread can be increased in a stepwise manner. Accordingly, when the tapping screw 300 is tightened into the hole 522, stress applied to the hole 522 increases in a stepwise manner, and therefore, excessive stress can be prevented from being applied to the hole 522.

According to the hole 522, since the first hole portion 522*a* has a straight tapered shape, the screw thread portion of the tapping screw 300 bites from not a portion near the attachment surface 521 but a high strength portion corresponding to a deep portion of the first hole portion 522*a*. Accordingly, peeling and cracking can be prevented from occurring in the hole 522, the fan frame 1 having the hole 522, and so on.

Furthermore, according to the hole 522, since the first hole portion 522*a* has a straight tapered shape, when the tapping screw 300 is fixed into the hole 522, the tapping screw 300 is guided to the tapered portion of the hole 522, and the angle of the tapping screw 300 becomes straight. Accordingly, an amount of the screw thread of the tapping screw 300 biting the hole 522 is fixed, and the torque required when the tapping screw 300 is tightened into the hole 522 can be fixed.

(4) The first hole portion 532*a* of the hole 532 opened in the attachment surface 531 of FIG. 11 is reduced in diameter toward the second hole portion 532*b* and, at the same time, curved convexly inward the axis direction toward the second hole portion 532*b*. That is, in the hole 532, the first hole portion 532*a* opened in the attachment surface 531 has a tapered shape curved inward. According to the hole 532, a large engagement amount of the screw thread of the tapping screw 300 can be secured from the beginning of fixing of the tapping screw 300 into the hole 532. Accordingly, the tapping screw 300 can be tightened into the hole 532 with a high torque from the beginning.

(5) The first hole portion 542*a* of the hole 542 opened in the attachment surface 541 of FIG. 12 is reduced in diameter toward the second hole portion 542*b* and, at the same time, curved concavely outward the axis direction toward the second hole portion 542*b*. That is, in the hole 542, the first hole portion 542*a* opened in the attachment surface 541 has a tapered shape curved outward. According to the hole 542, the engagement amount of the screw thread of the tapping screw 300 can be reduced at the beginning of fixing of the tapping screw 300 into the hole 542. Accordingly, when the tapping screw 300 is tightened into the hole 542, a load applied to the hole 542 can be reduced.

(6) The first inclining portion 552*aa* of the first hole portion 552*a* of the hole 552 opened in the attachment surface 551 of FIG. 13 is linearly inclined to be reduced in diameter. The second inclining portion 552*aa* of the first hole portion 552*a* extends from the first inclining portion 552*aa* and is linearly inclined to be further reduced in diameter toward the second hole portion 552*b*. That is, in the hole 552, the first inclining portion 552*aa* of the first hole portion 552*a* opened in the attachment surface 551 has a chamfered shape. According to the hole 552, when the first inclining portion 552*aa* of the first hole portion 552*a* is ground with the tapping screw 300, the load applied to the first inclining portion 552*a* formed into a chamfered shape can be reduced.

(7) The convex portion 562*aa* of the first hole portion 562*a* of the hole 562 opened in the attachment surface 561 of FIG. 14 is reduced in diameter toward the second hole portion 562*b* and, at the same time, curved convexly inward the axis direction toward the second hole portion 562*b*. The inclining portion 562*ab* of the first hole portion 562*a* extends from the convex portion 562*aa* and is linearly inclined to be further reduced in diameter toward the second hole portion 562*b*. That is, in the hole 562, the convex portion 562*aa* of the first hole portion 562*a* opened in the attachment surface 561 has a tapered shape curved inward. According to the hole 562, a large engagement amount of the screw thread of the tapping screw 300 is secured from the beginning of fixing of the tapping screw 300 into the hole 562, and thereafter the load applied to the convex portion 562*aa* can be reduced.

(8) The concave portion 572*aa* of the first hole portion 572*a* of the hole 572 opened in the attachment surface 571 of FIG. 15 is reduced in diameter toward the second hole portion 572*b* and, at the same time, curved concavely outward the axis direction toward the second hole portion 572*b*. The inclining portion 572*ab* of the first hole portion 572*a* extends from the concave portion 572*aa* and is linearly inclined to be further reduced in diameter toward the second hole portion 572*b*. That is, in the hole 572, the concave portion 572*aa* of the first hole portion 572*a* opened in the attachment surface 571 has a tapered shape curved outward. According to the hole 572, the engagement amount of the screw thread of the tapping screw 300 is reduced from the beginning of fixing of the tapping screw 300 into the hole 572, and thereafter the load applied to the concave portion 572*aa* can be reduced.

(9) The inclining portion 582*aa* of the first hole portion 582*a* of the hole 582 opened in the attachment surface 581 of FIG. 16 is linearly inclined to be reduced in diameter toward the second hole portion 582*b*. The concave portion 582*ab* of the first hole portion 582*a* extends from the inclining portion 582*aa*, is further reduced in diameter toward the second hole portion 582*b*, and is curved concavely outward the axis direction toward the second hole portion 582*b*. That is, the hole 582 has a tapered shape in which a rectilinear portion and a curved portion are continuously provided. According to the hole 582, when the tapping screw 300 is fixed into the hole 582, the stress applied from the tapping screw 300 to the hole 582 can be reduced by being dispersed in different directions.

(10) The concave portion 592*aa* of the first hole portion 592*a* of the hole 592 opened in the attachment surface 591 of FIG. 17 is reduced in diameter toward the second hole portion 592*b* and, at the same time, curved concavely outward the axis direction toward the second hole portion 592*b*. The convex portion 592*ab* of the first hole portion 592*a* extends from the concave portion 592*aa*, is further reduced in diameter toward the second hole portion 592*b*, and is curved convexly inward the axis direction toward the second hole portion 592*b*. That is, the hole 592 has a tapered shape in which curved portions including concave and convex shapes are continuously provided. According to the hole 592, when the tapping screw 300 is fixed into the hole 592, the stress applied from the tapping screw 300 to the hole 592 can be reduced by being dispersed radially.

(11) In the hole 20, when the tapping screw 300 is inserted through the hole 20, a screw groove is formed. Thus, the hole 20 can be applied to a constitution in which for example when a screw is inserted through the hole 20 while forming the screw groove, a large load is applied.

(12) The second hole portion 20*b* of the hole 20 is constituted of a through-hole or a hole having a predetermined depth. Thus, the hole 20 can be applied to both the through-hole and the hole having a predetermined depth and has high versatility.

(13) One or more holes are provided in the direction in which the tapping screw 300 is inserted therethrough. For example, the fan frame 1 can have a complete rib shape in which the hole 20 is inserted through the entire region ranging from the attachment surface 10 to the surface facing the attachment surface 10. In this case, the single hole 20 is provided at each of the four corners of the attachment surface 10 of the fan frame 1 of FIG. 2 in the direction in which the tapping screw 300 is inserted through the hole 20. Meanwhile, for example, the fan frame 2 can have an open rib shape having a space in the region ranging from the attachment surface 40 to the attachment surface 60 facing the attachment surface 40. In this case, with regard to the holes 50 and 70, a total of two holes consisting of each one of the holes 50 and 70 are provided at each of the four corners of the fan frame 2 of FIG. 19 in the direction in which the tapping screw 300 is inserted through the hole. Thus, the hole can be applied to both the fan frame 1 having a complete rib shape and the fan frame 2 having an open rib shape and has high versatility.

In the fan frame 2 having an open rib shape, when the tapping screw 300 is fixed into the hole 50 and the hole 70, a load is applied to the insertion side and the exit side. Accordingly, in the fan frame 2 having an open rib shape, in the hole 50 and the hole 70, the fan frame 2 may have a tapered shape on each of the insertion side and the exit side.

Hereinbefore, although the preferred embodiments of the invention have been described, these embodiments are examples for the purpose of describing the invention, and it is not intended to limit the scope of this invention to only the above embodiments. That is, this invention can be practiced in various aspects different from the above first and second embodiments without departing from the gist of the invention.

What is claimed is:

1. A fan frame capable of accommodating a fan for blowing air or cooling, the fan frame comprising:

a tapping screw having a head and a shaft, the head having a maximum diameter;

a hole in the fan frame for fixing the tapping screw, wherein the hole includes:

a first hole portion opened in an attachment surface onto which a supporting member fixed by the tapping screw is attached and a second hole portion extending from the first hole portion and having a predetermined inner diameter, and wherein the first hole portion is formed to have a diameter larger than that of the second hole portion and continuously reduced in diameter toward the second hole portion, and at least a portion of the first hole portion is curved convexly inward an axis direction toward the second hole portion or curved concavely outward the axis direction toward the second hole portion;

wherein the maximum diameter of the first hole portion is smaller than the maximum diameter of the head of the tapping screw, such that the head cannot fully enter the first hole portion; and wherein when the shaft of the tapping screw is fully inserted into the hole the first hole portion defines an air gap around the shaft.

2. The fan frame according to claim 1, wherein the first hole portion of the hole comprises a convex portion reduced in diameter toward the second hole portion and, at the same time, curved convexly inward the axis direction toward the second hole portion and an inclining portion extending from the convex portion and linearly inclined to be further reduced in diameter toward the second hole portion.

3. The fan frame according to claim 2, wherein the convex portion of the first hole portion is opened in the attachment surface, the inclining portion is provided between the convex portion and the second hole portion, and when the tapping screw is inserted, the inclining portion of the first hole portion and the second hole portion are formed with screw grooves.

4. The fan frame according to claim 1, wherein the first hole portion of the hole comprises a concave portion reduced in diameter toward the second hole portion and, at the same time, curved concavely outward the axis direction toward the second hole portion and an inclining portion extending from the concave portion and linearly inclined to be further reduced in diameter toward the second hole portion.

5. The fan frame according to claim 4, wherein the concave portion of the first hole portion is opened at the attachment surface, the inclining portion is provided between the concave portion and the second hole portion, and when the tapping screw is inserted, the inclining portion of the first hole portion and the second hole portion are formed with screw grooves.

6. The fan frame according to claim 1, wherein the first hole portion of the hole comprises an inclining portion reduced in diameter toward the second hole portion and a concave portion extending from the inclining portion, further reduced in diameter toward the second hole portion, and curved concavely outward the axis direction toward the second hole portion.

7. The fan frame according to claim 6, wherein the inclining portion of the first hole portion is opened at the attachment surface, the concave portion is provided between the inclining portion and the second hole portion, and when the tapping screw is inserted, the concave portion of the first hole portion and the second hole portion are formed with screw grooves.

8. The fan frame according to claim 1, wherein the first hole portion of the hole comprises a concave portion reduced in diameter toward the second hole portion and, at the same time, curved concavely outward the axis direction toward the second hole portion and a convex portion extending from the concave portion, further reduced in diameter toward the second hole portion, and curved convexly inward the axis direction toward the second hole portion.

9. The fan frame according to claim 8, wherein the concave portion of the first hole portion is opened at the attachment surface, the convex portion is provided between the concave portion and the second hole portion, and when the tapping screw is inserted, the convex portion of the first hole portion and the second hole portion are formed with screw grooves.

10. The fan frame according to claim 1, wherein when the tapping screw is inserted through the hole, a screw groove is formed in the hole.

11. The fan frame according to claim 1, wherein the second hole portion of the hole comprises a through-hole or a hole having a predetermined depth.

12. The fan frame according to claim 1, wherein one or more holes are provided in a direction in which the tapping screw is inserted through the one or more holes.

13. A method for assembling a fan frame capable of accommodating a fan for blowing air or cooling, the method comprising:

identifying a tapping screw having a head and a shaft for assembling the fan frame, the head having a maximum diameter;

creating a hole in the fan frame for fixing the tapping screw, wherein the hole includes:

a first hole portion opened in an attachment surface onto which a supporting member fixed by the tapping screw is attached, having a maximum diameter at the attachment surface;

a second hole portion extending from the first hole portion and having a predetermined inner diameter;

wherein the first hole portion is formed to have a diameter larger than that of the second hole portion and continuously reduced in diameter toward the second hole portion, and at least a portion of the first hole portion is curved convexly inward an axis direction toward the second hole portion or curved concavely outward the axis direction toward the second hole portion;

inserting the tapping screw into the hole to the maximum permissible depth;

wherein the maximum diameter of the first hole portion is smaller than the maximum diameter of the head of the tapping screw, such that the head cannot fully enter the first hole portion during the inserting; and wherein when the shaft of the tapping screw is fully inserted into the hole the first hole portion defines an air gap around the shaft.

14. The fan frame according to claim 13, wherein the first hole portion of the hole comprises a convex portion reduced in diameter toward the second hole portion and, at the same time, curved convexly inward the axis direction toward the second hole portion and an inclining portion extending from the convex portion and linearly inclined to be further reduced in diameter toward the second hole portion.

* * * * *